US005826629A

United States Patent [19]

West

[11] Patent Number: 5,826,629

[45] Date of Patent: Oct. 27, 1998

[54] PNEUMATIC WIRE TYING APPARATUS

[75] Inventor: Joe E. West, Meridian, Tex.

[73] Assignee: John E. Burford, Austin, Tex.

[21] Appl. No.: 783,945

[22] Filed: Jan. 17, 1997

[51] Int. Cl.[6] ..... B21F 15/04

[52] U.S. Cl. ..... 140/119; 140/57

[58] Field of Search ..... 140/57, 93.6, 119

[56] References Cited

U.S. PATENT DOCUMENTS

| | | | |
|---|---|---|---|
| 2,945,514 | 7/1960 | Wyss | 140/93 R |
| 3,323,558 | 6/1967 | Collins | 140/93.6 |
| 4,354,535 | 10/1982 | Powell et al. | 140/119 |
| 4,362,192 | 12/1982 | Furlong et al. | 140/119 |
| 4,834,148 | 5/1989 | Muguruma et al. | 140/119 |

*Primary Examiner*—Lowell A. Larson

*Attorney, Agent, or Firm*—Akin, Gump, Strauss, Hauer & Feld, L.L.P.

[57] ABSTRACT

Apparatus for forming a twisted wire tie, includes a wire guide member moveable between an open position for receiving a workpiece, such as crossed reinforcing bars, and a closed position for guiding a length of wire around the bars. An abutment is engageable with the workpiece to hold the workpiece clamped between the guide member and the abutment and adjacent to a wire twist member engageable with opposite ends of a length of wire to form the twisted loop type closure or tie. Feed mechanism comprising opposed rotary feedwheels or a linear actuator and spaced apart wire clamps operate in conjunction with closure of the guide member to a wire receiving position to feed wire to the guide member. A wire holder and drag force exerting plate is supported adjacent to the twist member for engagement with the wire ends to impart drag forces on the wire as it is twisted to form the closure. In one embodiment the motor may be connected to a lead screw and follower arrangement for controlling the number of twists and in another embodiment the motor may be operably connected to a lead screw and timing nut and associated mechanism for controlling an operating cycle.

49 Claims, 12 Drawing Sheets

PNEUMATIC WIRE TYING APPARATUS

FIELD OF THE INVENTION

The present invention pertains to a pressure fluid operated apparatus for tying a loop of twisted wire around an item. The apparatus is particularly adapted for tying steel reenforcing bars together.

BACKGROUND

There are many applications for binding or tying articles together wherein a loop of wire, or similar flexible element, is formed by a predetermined length of wire, the ends of which are twisted together to form a closure or tie. One industrial application of twisted wire ties which is particularly labor intensive is in the construction industry wherein grids of steel reinforcing bars are provided to reinforce concrete structures, such as roadways, aircraft runways, and virtually any type of structure which utilizes reinforced concrete. Typically the grids of crossed steel reinforcing bars are tied together at each point where one bar crosses or intersects another bar. Such reinforcing bars are typically also provided in grids of nine inch to fifteen inch centers or spacings between bars and applying wire ties to each crossing point between two bars can be particularly expensive and time consuming when the ties are formed manually.

Accordingly, there has been a strongly felt need to develop a suitable wire tying apparatus which may be hand held so that an operator may move across a grid of reinforcing bars, for example, to carry out the wire tying operation. It is preferable that the apparatus be pressure fluid operated and, particularly, adapted for use with pressure air since this power medium is readily available at most construction sites.

A power operated wire tying apparatus must, of course, also be operable to feed discrete lengths of wire to a wire tying station on the apparatus from a continuous or at least substantial length of wire, such as a storage spool or reel. Further desiderata in wire tying apparatus include providing means for reliably feeding predetermined lengths of wire to provide a wire tie of a predetermined size. The apparatus also should desirably include means for holding the apparatus firmly against the workpieces to be tied together but also be quickly releasable from the workpieces when the tie is completed and without damaging or partially untwisting the tie. Still further, the apparatus should be capable of operating with wires of different diameters and stiffness as well as wire which may be coated with a protective coating or the like. These desiderata have been strongly felt in efforts to develop power operated wire tying apparatus and it is to these ends that the present invention has been developed.

SUMMARY OF THE INVENTION

The present invention provides a powered wire tying apparatus for forming a loop of twisted wire for tying a workpiece or workpieces. In particular, the present invention provides a powered wire tying apparatus for tying steel reinforcing bars or rods and similar articles together.

The present invention meets the desiderata mentioned above in that a pressure fluid operated, preferably pneumatic, apparatus is provided wherein a length of wire to be formed into a tie may be predetermined by means on the apparatus and, upon initiation of an operating cycle of the apparatus wire is fed to and guided around the workpiece to be tied, the predetermined length of wire is cut and the ends of the cut length of wire are twisted together in a selected number of twists or wraps. The apparatus then automatically releases itself from the workpieces which have been tied and resets itself for carrying out another operating cycle.

In accordance with an important aspect of the present invention a wire guide member is provided on the apparatus which is automatically moved from an open position to receive a workpiece to a position to form a wire tie around the workpiece or workpieces. The guide member is moved to a position to receive wire from a feed mechanism for guiding the wire to a position to be engaged by a wire twist or wrap forming member and the wire guide member is then automatically retracted upon the completion of the wire tying operation. The wire guide member includes a wire receiving channel or groove therein which holds the wire prior to the wire tying operation but releases the wire as the tie or loop is being formed with the ends of the wire twisted together. The wire guide member is also cooperable with a workpiece engagement member which biases the workpiece, such as intersecting reinforcing bars, in a position for applying the wire tie to the junction of the bars and the workpiece engagement member may be automatically moved to allow the apparatus to be easily removed from the vicinity of the workpiece after the tying operation is complete.

The wire tying apparatus of the invention also includes a member engageable with opposite ends of a precut length of wire which will be formed into the tie, which member imparts a holding or drag force on the wire ends to allow a wire twist member to form a plurality of tightly engaged wraps of the ends of the wire and a loop portion which is snugly engaged with the workpiece or workpieces. In one embodiment of the wire end holding member, the member is moveable between a position for holding the wire during the tying operation and a retracted position to move clear of the wire ends to prevent snagging the wire ends or otherwise damaging the wire tie.

The present invention is illustrated and described in accordance with two embodiments, each of which has a wire feed mechanism which automatically feeds or advances a length of wire to be formed in a wire tie or loop, is operable in conjunction with mechanism for moving a wire guide member between a working and non-working position and is cooperable with a drive mechanism for rotating a wire twist member.

One embodiment of the present invention further includes mechanism for conveniently adjusting the length of wire to be formed into a loop with twisted ends and mechanism which may be adjusted to predetermine the number of wraps or twists formed by the opposite ends of the length of wire which forms the tie.

The present invention provides an apparatus which substantially improves the process of providing a flexible wire tie wherein a loop is formed by twisting the ends of a discrete length of wire together in one or more helical wraps for the purpose of tying articles together or to form a closure or a connection between plural articles. Those skilled in the art will further appreciate the advantages and superior features of the invention upon reading the detailed description which follows in conjunction with the drawing.

DESCRIPTION OF THE PREFERRED EMBODIMENTS

Figure 1:
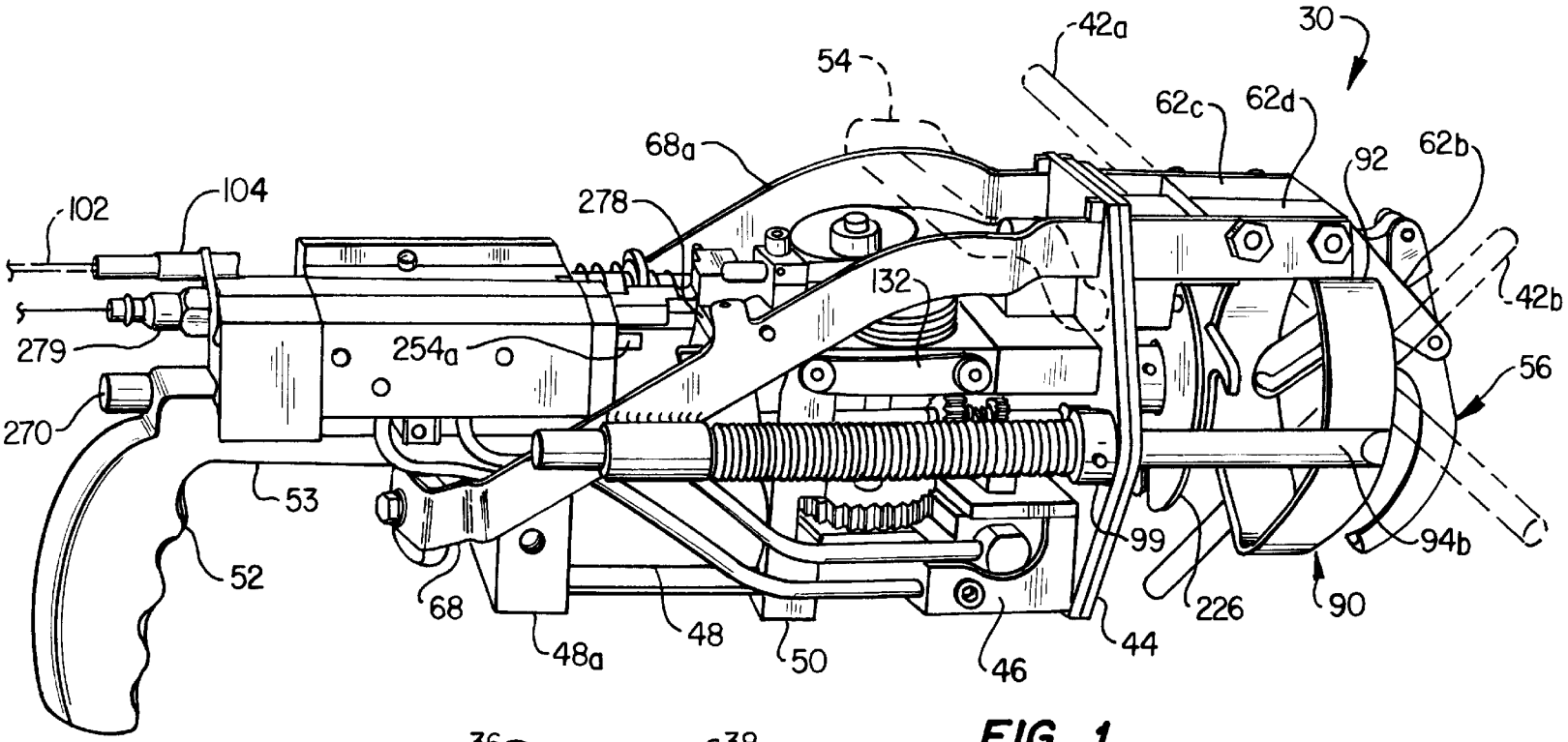
FIG. 1 is a side view of a pneumatic wire tying apparatus in accordance with the invention.

In the description which follows like elements are marked throughout the specification and drawing with the same reference numerals, respectively. The drawing figures are not necessarily to scale and certain elements may be shown in somewhat schematic or generalized form in the interest of clarity and conciseness.

Figure 2:
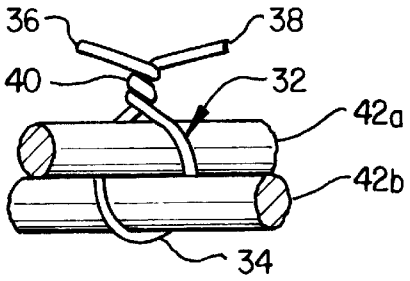
FIG. 2 is a detail view showing a wire loop tie disposed around intersecting steel reinforcing bars and produced by the apparatus shown in FIG. 1.
Figure 3:
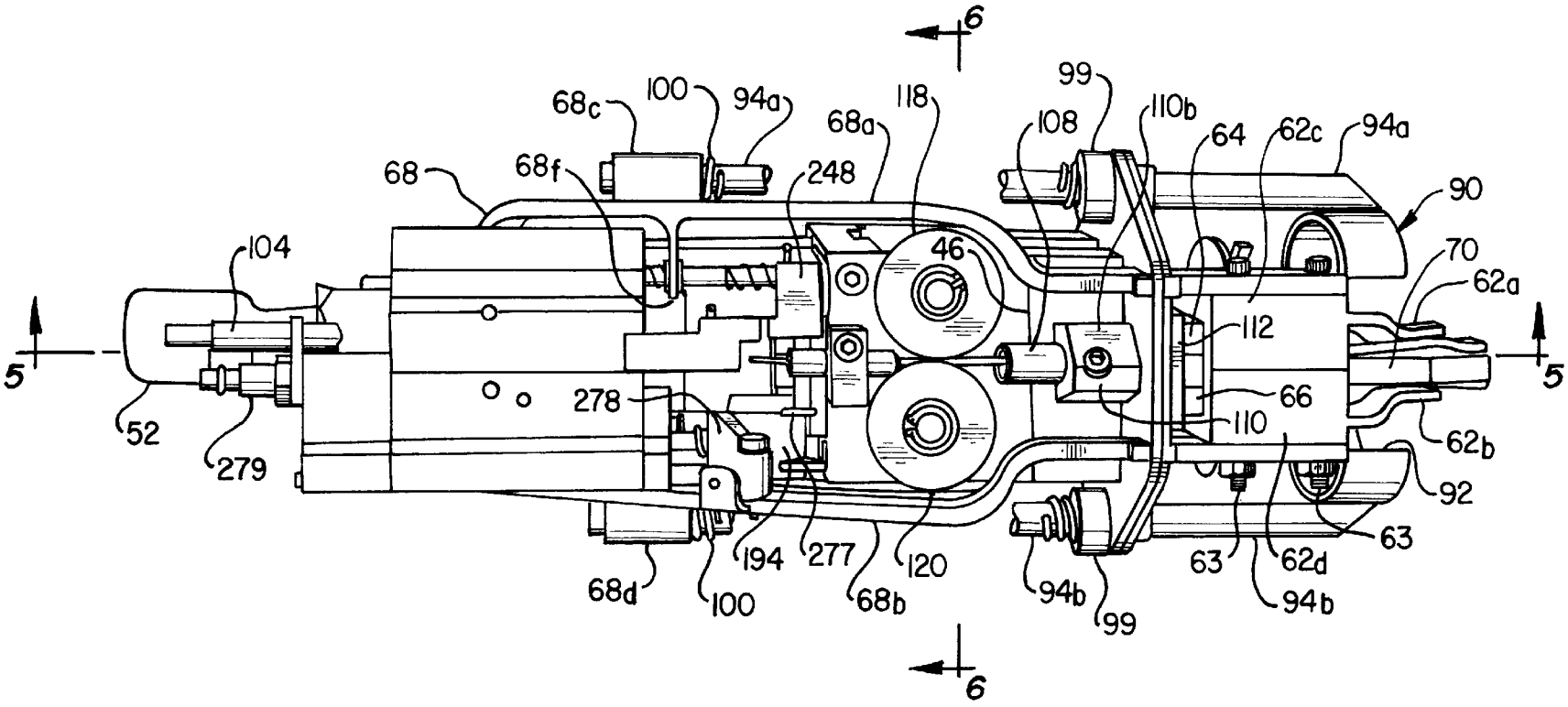
FIG. 3 is a top view of the apparatus shown in FIG. 1.
Figure 4:
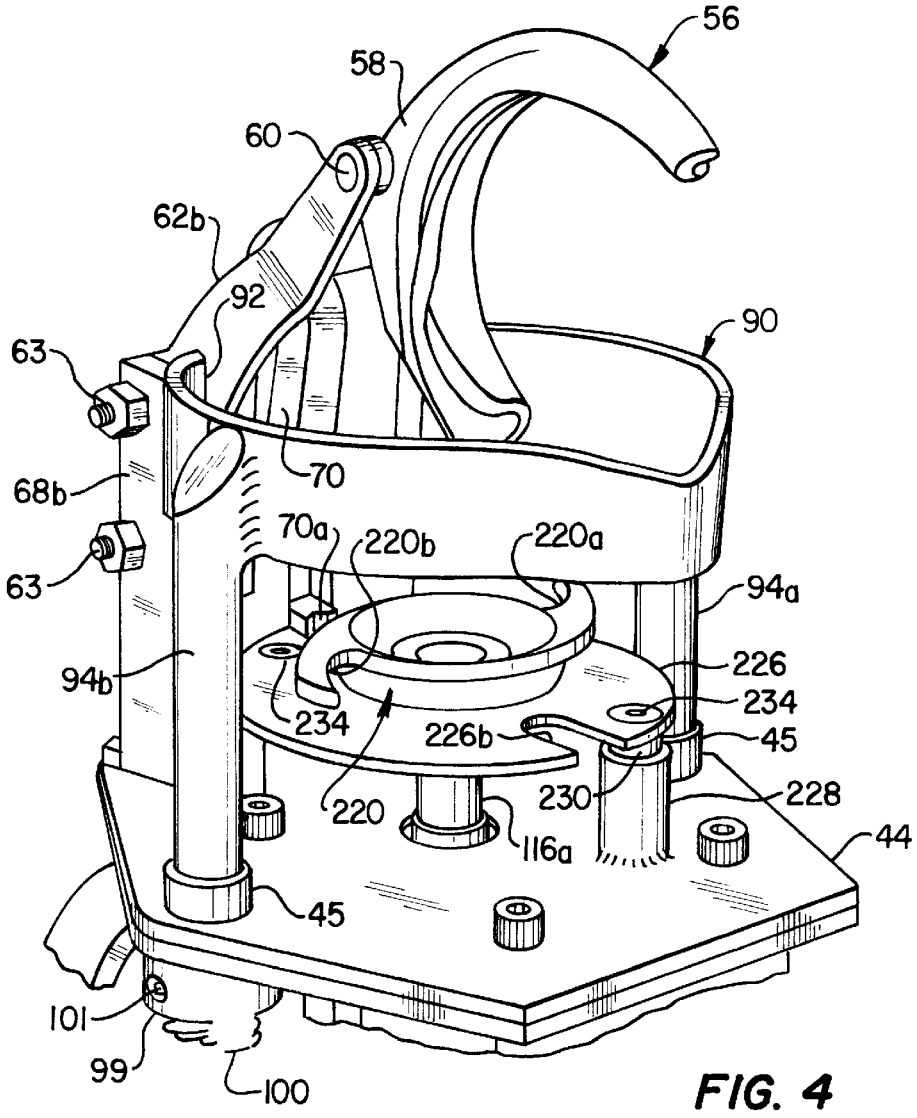
FIG. 4 is a perspective view showing certain details of the wire guide member, the workpiece engaging or abutment member, the wire twist member and the wire end holder member of the embodiment shown in FIGS. 1 and 2.

Referring to FIGS. 1, 3 and 4, in particular, a pressure fluid operated wire tying apparatus in accordance with the invention is illustrated and generally designated by the numeral 30. The apparatus 30 is operable to automatically form a wire loop closure from a predetermined length of flexible metal wire, or similar filamentary material which may be plasticly deformed, to comprise a tie or closure 32, see FIG. 2, characterized by a loop portion 34 and opposed ends 36 and 38 which have been twisted together in plural wraps 40, as shown. In a preferred embodiment, the apparatus 30 is adapted for making wire ties 32 around intersecting steel reinforcing rods 42*a* and 42*b* as shown in FIG. 2. In FIG. 1 the apparatus 30 is shown positioned at the intersection of rods 42*a* and 42*b* to form the wire tie 32.

Referring further to FIGS. 1, 2 and 3, the apparatus 30 comprises a frame including a generally transverse, two part support plate 44 comprising separable plates 44*a* and 44*b* suitably connected to each other and to a frame block 46 for supporting a wire guide actuator 48 by way of a frame member 50. An operator grip 52 includes a forearm part 53 and is also suitably connected to the frame comprising the assembled members 44, 46, actuator 48 and member 50 which may be connected by suitable fasteners and separated from each other to allow for assembly and disassembly of certain components of the apparatus 30. A second handle grip 54 may be connected to the frameplate 44, as shown in FIG. 1, for hand-held operation of the apparatus 30 to form a wire tie 32.

Figures 5A, 7, 8:
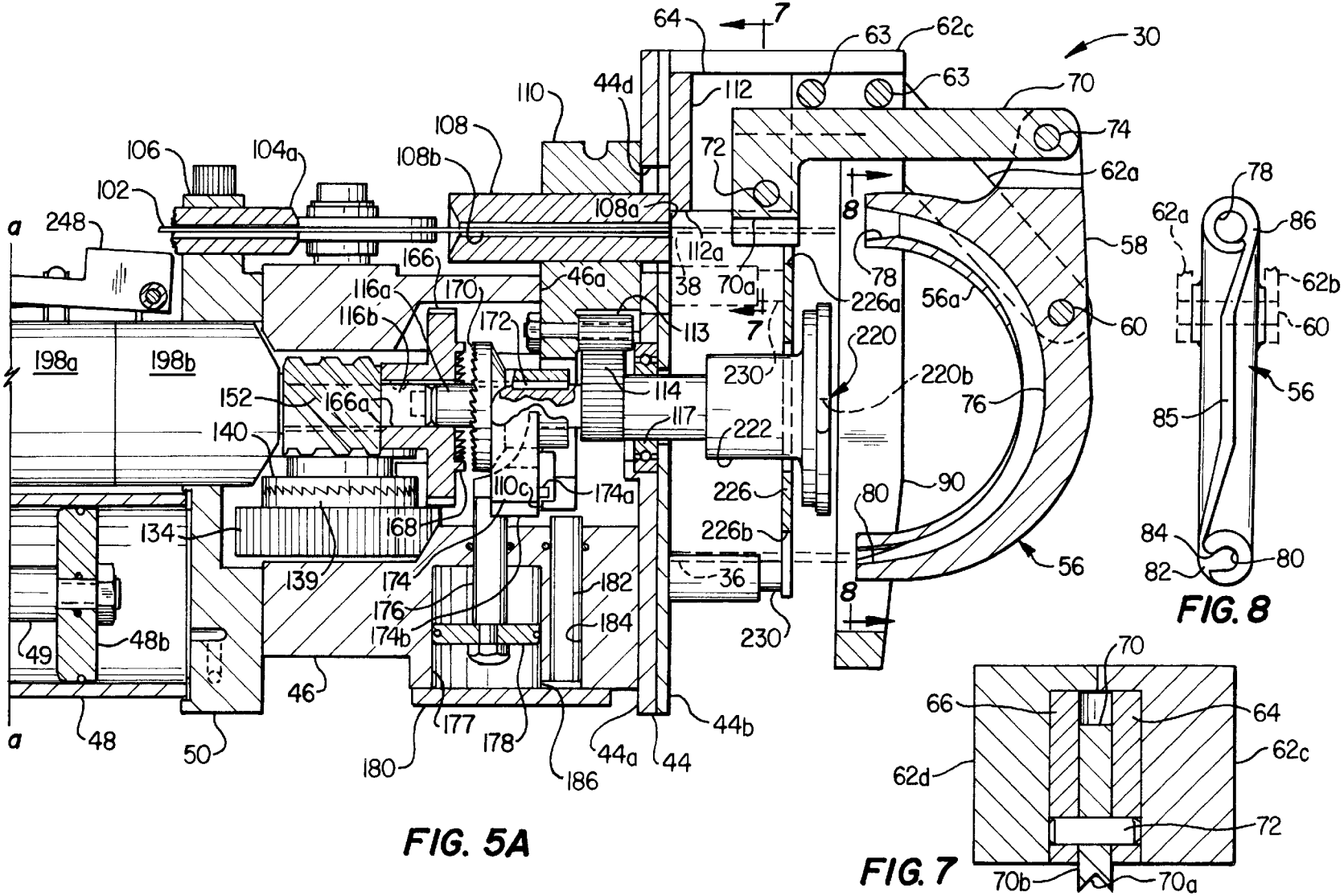
FIGS. 5A and 5B comprise a section view taken along the line 5—5 of FIG. 2.
FIG. 7 is a detail section view taken from the line 7—7 of FIG. 5A.
FIG. 8 is a detail view taken from the line 8—8 of FIG. 5A.
Figure 5B:
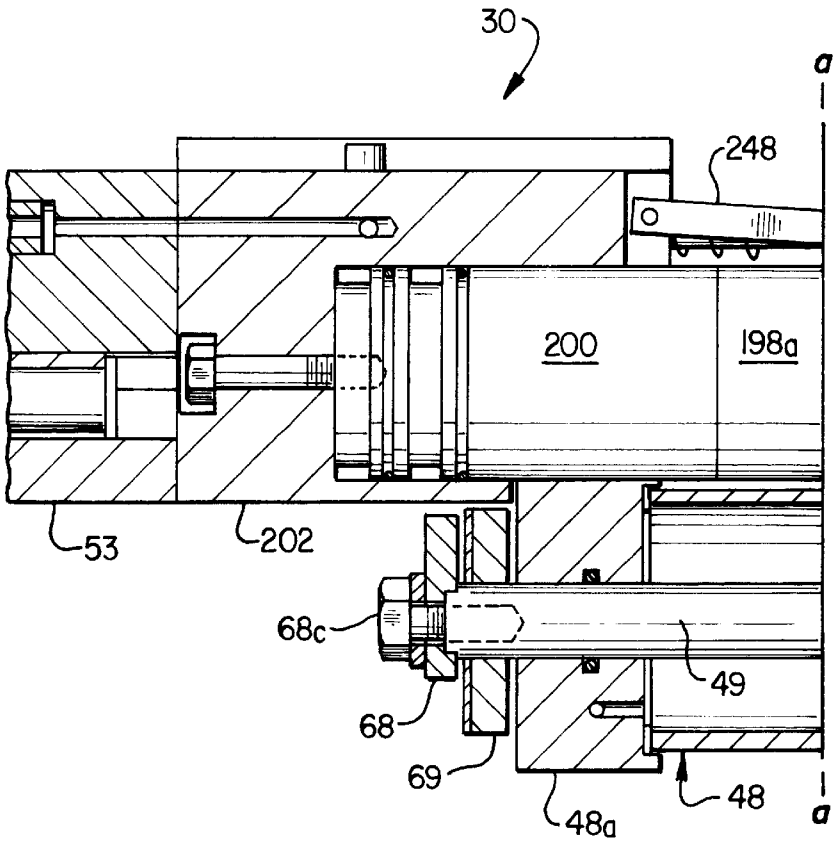

The wire tie 32 is formed by guiding wire in a somewhat arcuate path as controlled by an arcuate wire guide member 56. The wire guide member 56 is moved between an open position, shown in FIG. 4, and a fully closed position, as shown in FIG. 5A, by the pressure fluid cylinder and piston type actuator 48. The wire guide member 56 includes a projection 58 formed thereon and including a transverse bore for receiving a pivot pin 60, FIGS. 4 and 5A, whereby the guide member is connected to opposed arms 62*a* and 62*b*, FIGS. 1, 3, 4, 5A and 6, the distal ends of which are provided with suitable bores for receiving the pivot pin 60. The arms 62*a* and 62*b* include generally rectangular block-like hub portions 62*c* and 62*d*, FIGS. 1, 3, 5A AND 7, which are supported on spaced apart bosses 64 and 66, FIG. 7, which project from and are supported on the frame plate 44 and aid in supporting the arms 62*a* and 62*b*. The hub portions 62*c* and 62*d* are connected by suitable fasteners 63 to opposed arms 68*a* and 68*b* of a yoke 68 which is connected to a piston rod 49, FIG. 5B, of actuator 48 by a suitable fastener 68*c*. An elastomeric bumper 69, FIG. 5B, is interposed between the yoke 68 and the cylinder endwall 48*a* of actuator 48 to cushion the forward stroke of the actuator 48 when the wire guide member 56 is being moved to its open position.

As best shown in FIGS. 5A and 7, the wire guide member 56 is also supported for movement between its open and closed positions by a link 70 which is disposed between and pivotally connected to the bosses 64 and 66, FIG. 7, by a pivot pin 72. The opposite end of the link 70 is pivotally connected to the wire guide member 56 by a pivot pin 74, FIG. 5A. Upon movement of the actuator 48 to retract its piston rod 49 to the right, viewing FIG. 1, the yoke 68 is operable to move the wire guide member 56 from a closed position for guiding a length of wire around a workpiece to an open position as shown in FIG. 4. However, this movement is also controlled by the link 70 which is pivotally connected to the frame comprising the members 44, 64 and 66 and is allowed to pivot relative to the frame and the guide member 56 so that the guide member is free to linearly translate and rotate between open and closed positions. As shown in FIGS. 5A and 7, the link 70 also includes a wire guide slot 70*a* formed in an arm portion 70*b* of the link.

Referring further to FIGS. 5A and 8, the wire guide member 56 is characterized by a somewhat tubular shaped portion defining an arcuate wire guide groove 76 having an enlarged funnel shaped wire receiving inlet portion 78 and a linear exit portion 80. The exit portion 80 includes a slot 82 which opens laterally with respect to the plane of the groove 76 and includes a re-entrant edge 84 operable to hold a wire retained in the groove until it is forcibly removed by the operation which twists the wire ends together. Linear groove portion 80 is provided to straighten a length of wire as it exits the groove 76. As shown in FIG. 8 the entire length of the groove 76 opens generally to an arcuate inner surface 56*a* of the guide member 56, as indicated by interconnected slot portions 82, 85 and 86, FIG. 8, whereby a wire tie disposed in the groove 76 may move out of the wire guide member as the tie is being formed into the closure shown in FIG. 2. The guide member 56 may be moved between its open and closed positions shown in FIGS. 4 and 5A, respectively, by the actuator 48 which also includes a piston 48*b* reciprocal in a cylinder portion of the actuator 48 as shown in FIGS. 5A and 5B and connected to the piston rod 49. For purposes of discussion and illustration herein FIG. 5A and FIG. 5B are intended to be viewed joined together along the transverse line a—a.

Referring further to FIGS. 1, 2, 4 and 5A the apparatus 30 also includes a workpiece abutment member, designated by the numeral 90 and comprising a generally circular collar part, which is delimited by a slot 92, to provide clearance for the structure which supports the guide member 56 including the distal ends of the arms 68*a* and 68*b* at their point of connection to the hub portions 62*c* and 62*d*. The abutment member 90 is supported on spaced apart elongated cylindrical support rods 94*a* and 94*b* which project through suitable sleeve bearings 45 in the frame plate 44, FIG. 4, and are journaled by sleeves 68*c* and 68*d* supported on respective ones of the yoke arms 68*a* and 68*b*.

Each of the support rods 94*a* and 94*b* is provided with a spring stop collar 99 secured to the arms, respectively, for movement therewith. Elongated coil springs 100 are journaled on the rods 94*a* and 94*b* between the sleeves 68*c* and 68*d* and the respective stop collars 99. Accordingly, when the yoke 68 is actuated to move the guide member 56 to an open position the springs 99 are compressed and bias the abutment member 90 to a selected working position for engagement with the work pieces 42*a* and 42*b*, for example. However, the abutment member 90 is yieldably biased by the springs 100 acting through the collars 99. The collars 99 are fixed on the support rods 94*a* and 94*b* but may, if desired, be adjustably positioned on the support rods.

When the guide member 56 is actuated to move from the open position shown in FIG. 4 to the closed position shown in FIG. 5A the bias force acting on the abutment member 90 is reduced and the abutment member cooperates with guide 56 to clamp the workpieces between the guide member and the abutment member. When the actuator 48 is operated to retract piston rod 49 and move the guide member 56 to the open position the biasing force on the abutment member 90 is increased as the springs 100 are compressed between sleeves 68*c* and 68*d* and the collars 99 and the limit position of the abutment member is determined by engagement of the collars 99 with frame plate 44.

Referring further to FIG. 1, 2 and 5A a suitable wire or similar filament 102 may be fed through a guide tube 104 supported on the grip 52, 53. The guide tube 104 includes a distal portion 104*a* which is suitably supported by a removable clamp 106, FIG. 5A, supported on the frame block member 50. A second wire guide tube and cutoff member 108, FIG. 5A, is supported on a moveable support member 110 which is mounted in the frame block 46 for reciprocating movement in a vertical direction, viewing FIG. 5A. The wire guide and cutoff member 108 projects through a slot 44*d* formed in the frame plate 44 and includes a distal end face 108*a* which is adapted to be positioned directly adjacent a surface of a wire cutoff member 112 mounted on the frameplate 44 at the slot 44*d*. The wire guide and cutoff member 108 includes a suitable passage 108*b* formed therein for movement of the wire therethrough and toward the wire guide 70*a* in the link 70.

The support member 110 is operable to be reciprocably disposed in a slot 46*a* formed in the support block 46 and includes a cam follower 113 mounted thereon and engageable with a cam 114 mounted on a rotary drive shaft part 116*a* of the apparatus 30, as shown in FIG. 5A. In response to rotation of the shaft 116*a* the cam 114 is operable to move the support member 110 and the wire guide member 108 vertically, viewing FIG. 5A, until the passage 108*b* passes the transverse edge 112*a* of the cutoff member 112 whereby a wire is severed at the end face 108*a* of the guide member. As shown in FIG. 3, the support member 110 may have a removable clamp part 110*b* for clamping the guide and cutoff member 108 in a selected position and whereby the member 108 may be removed for dressing the face end 108*a* to provide for a clean and sharp cut for a length of wire to be supported by the guide member 56 as the wire is fed through the guide tube 104, the guide member 108 past the guide slot 70*a* and into the slot 76.

Figure 6:
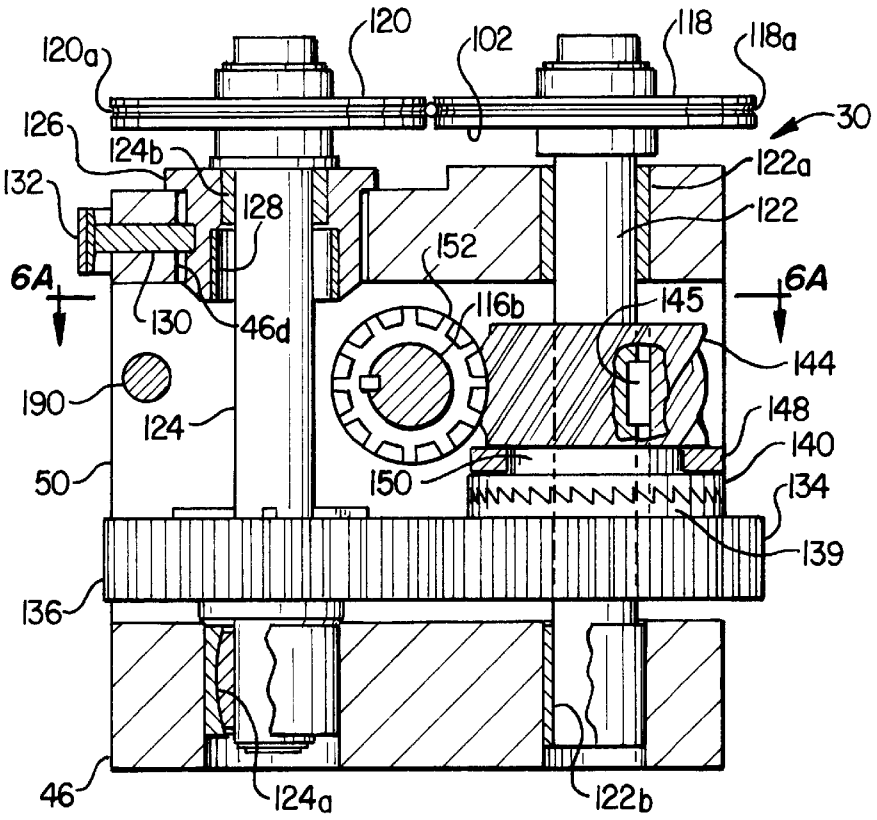
FIG. 6 is a section view taken generally from the line 6—6 of FIG. 2.

Referring further to FIGS. 3, 5A and 6, wire 102 is fed to position for forming a closure by a pair of opposed wire feedwheels 118 and 120 include suitable circumferential wire receiving grooves 118*a* and 120*a* formed thereon. Feedwheels 118 and 120 are supported on the frame support block 46 for rotation on and with respective support shafts 122 and 124. Shaft 122 is supported in spaced apart sleeve bearings 122*a* and 122*b*, FIG. 6, while shaft 124 and feed wheel 120 are journaled by a spherical or universal bearing 124*a* at the end of shaft 124 opposite the feed wheel 120. Shaft 124 is also supported by a sleeve bearing 124*b* mounted in a laterally moveable hub 126 which is supported in a recess 46*d* formed in the support block 46. The hub 126 supports a one-way rotary clutch, such as a so called sprag type clutch 128, engageable with the shaft 124 and the hub 126 and operable to permit rotation of the feed wheel 120 in a clockwise direction, viewing FIG. 3, while preventing rotation in the opposite direction. However, the hub 126 is prevented from rotating with respect to the frame block 46 by a moveable cylindrical pin type key 130 which projects into a cooperating bore formed in the hub 126 and is biased into engagement with the hub by a suitable leaf spring 132.

The key 130 is axially moveable in a bore formed in the frame block 46, as shown in FIG. 6, and in response to movement of the spring 132 away from the key, the key may be moved to allow rotation of the hub 126 in the event that it is desired to allow the feedwheel 120 to rotate in the opposite direction. Spring 132 and key 130 also normally bias hub 126 and feedwheel 120 toward feedwheel 118.

As further shown in FIG. 6, the feedwheel support shafts 122 and 124 each support spur gears 134 and 136 respectively, which are meshed with each other. Gear 136 is suitably keyed to shaft 124 for rotatably driving the shaft to rotate in a direction which will feed wire 102 toward the wire guide member 56. Gear 134 is mounted on shaft 122 for rotation relative thereto and includes a hub portion forming a driven clutch member 139 of a positive engagement or so-called dog type clutch. A driving clutch 140 is axially slidable on the shaft 122 and connected to a forty-five degree helical gear 144. The gear 144 and driving clutch member 140 are keyed for rotation with the shaft 122 by suitable key means 145 supported on the shaft 122 and disposed in an axial slot formed in the gear 144 to allow the gear 144 and the clutch member 140 to move axially into and out of engagement with the driven clutch member 139. Movement of the gear 144 and clutch member 140 axially along shaft 122 is under the control of a shifter fork 148 operably engaged with the gear 144 and the clutch member 140 and disposed in a suitable annular groove 150 formed therebetween. As shown in FIG. 6 also, gear 144 is meshed with a driving, forty-five degree helical gear 152 forming a right angle drive with gear 144. Gear 152 is supported on and drivenly connected to a shaft 116*b*. Shafts 116*a* and 116*b* are coaxial and rotatable with each other as one shaft, as well as being rotatable relative to each other.

Figures 6A, 6B:
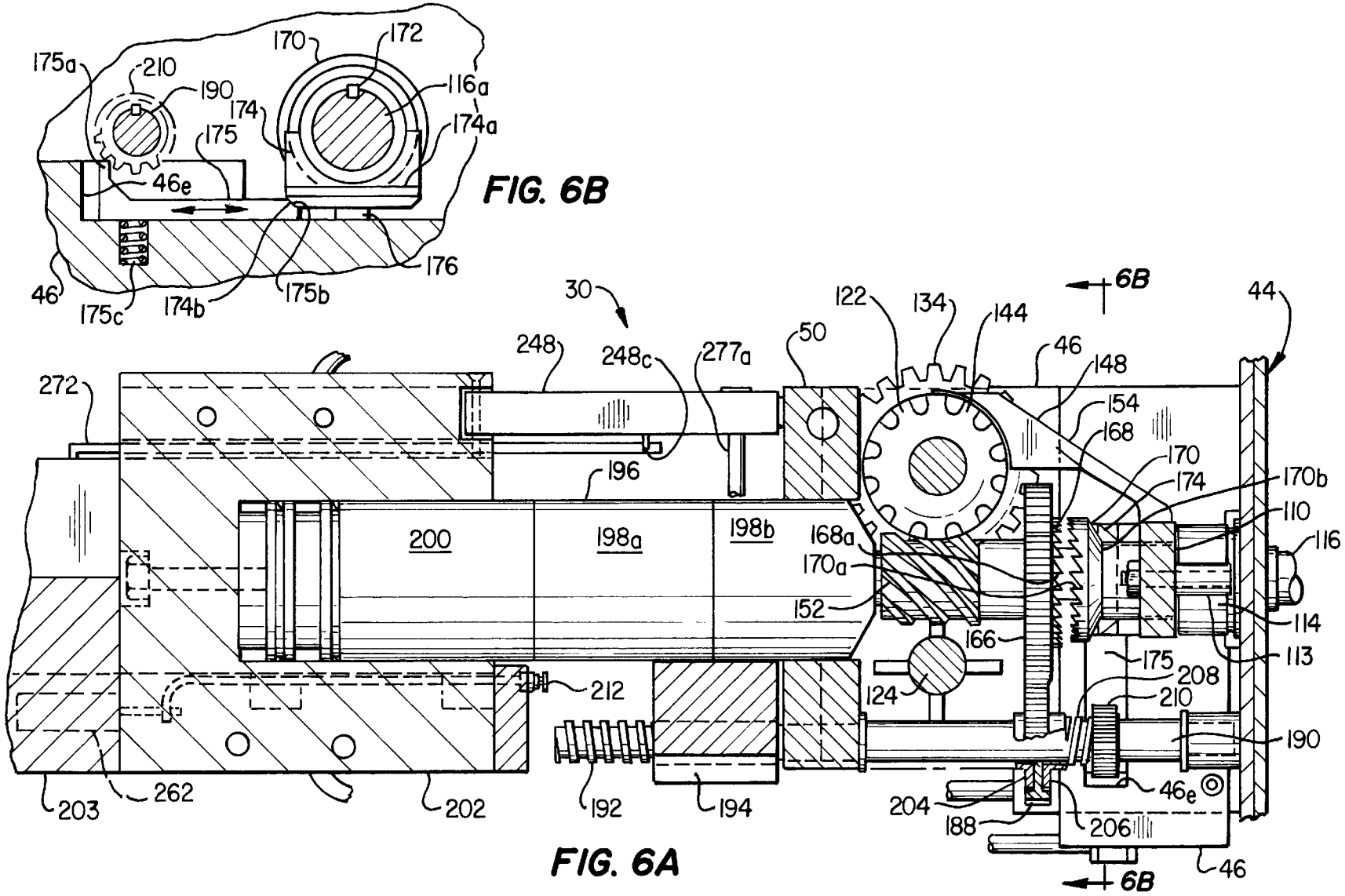
FIG. 6A is a section view taken from line 6A—6A of FIG. 6.
FIG. 6B is a detail section view taken from line 6B—6B of FIG. 6A.

As shown in FIG. 6A, the shifter fork 148 is connected to an arm 154 which, in turn, is connected to the wire guide support member 110 which, as previously described, is slidable with respect to and supported by the frame block 46. Accordingly, when the shifter fork 148 moves downwardly, viewing FIG. 6, in response to movement of the support member 110 to the position shown in FIG. 5A, clutch members 139 and 140 are engaged to drive gears 134 and 136 to rotate the feedwheels 118 and 120 to feed wire 102 toward the guide member 56. Thanks to the spherical bearing 124*a* shaft 124 is operable to allow lateral movement of the feedwheel 120 toward and away from the feedwheel 118. The combination key and biasing member 130 urges the hub 126 and the feedwheel 120 toward the feedwheel 118 and wire 102 is forcibly engaged by the feedwheels as they rotate to feed wire toward the guide member 56. As mentioned previously, the sprag clutch 128 allows the shaft 124 to rotate the wire feedwheel 120 to feed wire but prevents rotation in the opposite direction unless the hub 126 is released from engagement with the key 130. When the support member 110 is moved upwardly, viewing FIG. 5A, the shifter fork 148 is moved to disengage clutch member 140 from clutch member 139 thereby causing the feedwheels 118 and 120 to cease rotation as a predetermined length of wire is cut off by movement of the distal end face 108*a* of the guide member 108 across the edge 112*a* of wire cut off member 112.

Referring again to FIGS. 5A and 6A, shaft 116*b* is drivenly engaged with a spur gear 166 which includes a driving clutch member 168 formed thereon. One end of shaft 116*a* is journaled in bore 166*a* of gear 166 and is rotatable therein. A driven clutch member 170 is mounted on shaft 116*a*, is axially slidable relative to the shaft 116*a* but keyed to shaft 116*a* for rotation therewith by key means 172, FIG. 5A. The clutch members 168 and 170 are preferably provided with cooperating teeth or clutch dogs 168*a* and 170*a*, respectively, FIG. 6A, which are operable to remain in driving engagement when clutch member 168 is rotating in the direction to drive a twist member described further herein to twist wire, but clutch dogs 168*a* and 170*a* are provided with inclined surfaces which bias the clutch member 170 to disengage from member 168 when member 168 is rotating in the opposite direction during the wire feed portion of an operating cycle. A clutch shifter fork 174 is engageable with a hub portion 170*b* of driven clutch member 170, FIG. 6A, for shifting driven clutch member on shaft 116*a* into engagement with driving clutch member 168. Shifter fork 174 is connected to a pressure fluid piston and cylinder actuator including a piston rod 176 connected to a piston 178 disposed in a cylindrical bore 177 formed in frame block member 46 and closed by a head 180. Shifter fork 174 includes a laterally projecting tab 174*a* formed thereon and engageable with a finger 110*c* formed on member 110 for biasing the member 110 downwardly, viewing FIG. 5A, when shifter fork 174 is moved to allow clutch member 170 to disengage from clutch member 168 under the interaction between the aforementioned inclined surfaces on the cooperating clutch teeth or dogs 168*a* and 170*a*. A second actuator comprising a piston 182 is disposed in a bore 184 formed in frame block 46 generally parallel to and adjacent to the bore 177. A pressure fluid passage 186 is formed between the bores so that when the piston 178 is urged to bias the shifter fork 174 to engage the clutch 168, 170, piston 182 biases member 110 and wire guide and cutoff member 108 to a position wherein cam follower 113 is out of engagement with cam 114.

Referring further to FIG. 6A, gear 166 is meshed with a driven gear 188 which is supported on a lead screw shaft 190 supported for rotation on and between frame members 44 and 50. Shaft 190 is drivingly connected to a lead screw 192 which is threadedly engaged with a lead screw nut 194 operable to translate axially along the lead screw but not rotate relative to the lead screw. In this regard, nut 194 is engageable with a housing 196 for a two stage speed reduction gear drive 198*a*, 198*b* drivingly connected to shaft 116*b* and interconnecting shaft 116*b* with a reversible pressure fluid operated motor 200. Motor 200 and gear reduction drive mechanisms 198*a* and 198*b* are supported on the apparatus 30 by and between frame block 50 and a frame support block 202 which is suitably connected to combination actuator head and frame block 48*a*, FIG. 5B. Grip 52, 53 is suitably mounted on block 202.

Referring still further to FIG. 6A, gear 188 is axially slidable on and rotatable relative to shaft 190 and is adapted to be biased into engagement with a hub 204 supported on and fixed to shaft 190 for rotation therewith. A second hub 206 is biased into engagement with gear 188 by a coil spring 208 interposed between a gear 210 mounted on shaft 190 and hub 206. Spring 208 urges hub 206 and gear 188 into engagement with hub 204 to form a slip clutch connection between the gear 188 and the shaft 190 whereby lead screw 192 may be rotated to cause nut 194 to translate axially to the left, viewing FIG. 6A, until nut 194 engages an actuator member 212 for a control valve to be described in further detail herein.

Referring also to FIG. 6B, gear 210 is keyed for rotation with shaft 190 and is engageable with a pawl 175 disposed in a slot 46*e* in frame block 46. Pawl 175 includes a projection 175*a* engageable with the teeth of gear 210 to prevent rotation thereof and a cam surface 175*b* engageable with a cooperating cam surface 174*b* disposed on the shifter fork 174. A spring 175*c* is supported on frame block 46 and is operable to bias the pawl 175, 175*a* into engagement with gear 210. However, when shifter fork 174 is retracted to allow clutch members 168 and 170 to disengage, cam surfaces 175*b* and 174*b* cooperate to move pawl 175 to a position wherein the projection 175*a* will not prevent rotation of gear 210 and shaft 190.

Referring now to FIGS. 4 and 5A, shaft 116*a* is supported in a suitable bearing 117 in frame plate 44 and projects through the frame plate in supportive and driving relationship to a wire twist member 220 including a hub portion 222 suitably removably and drivably secured to the shaft 116*a*. As shown in FIG. 4, wire twist member 220 includes opposed radially projecting hook portions 220*a* and 220*b* which are operable to engage opposite end portions 36 and 38 of a length of wire projecting from the slot or groove 76 toward the frame plate 44 when the wire has been fed into position to be engaged by the hook portions, see FIG. 5A. The hook portions 220*a* and 220*b* have a suitable concave arcuate shape to cause and allow the wire ends to move radially inwardly toward the axis of rotation of shaft 116*a* as the twist member 220 rotates in a counter-clockwise direction, viewing FIG. 4.

As further shown in FIGS. 4 and 5A, a generally circular wire holder and drag plate member 226 is mounted in a stand off position from the frame plate 44 by one or more bosses 228, one shown in FIG. 4 with removable interchangeable spacers 230 interposed between the bosses and the holder plate 226. The holder plate 226 is suitably mounted on the bosses 228 by removable fasteners 234, for example. Wire holder and drag plate 226 is provided with two opposed, radially outwardly projecting slots 226*a* and 226*b*, FIG. 5A, which are aligned with the plane of the groove 76 and with the inlet and outlet portions 78 and 80 of the groove so that when a length of wire is fed into the groove 76 and cut off at the surface of frame plate member 44*b* by the afore-described cut-off mechanism, the ends of the wire are positioned closely adjacent to the surface of the frameplate 44*b* and extend through slots 226*a* and 226*b*.

Accordingly, as the wire twist member 220 rotates to engage the opposite ends of the wire in the hook portions 220*a* and 220*b*, the length of wire extending between the plate 226 and the frame plate 44*b* will engage the sides of the slots 226*a* and 226*b* whereupon a certain amount of drag forces will be incurred as the wire is twisted together to form the helical wraps shown in the example in FIG. 2. In this way the wire holder and drag plate 226 is operable to effectively tension the opposite ends of the wire which will be formed in a loop, such as the loop 34 which may be snugly formed around a workpiece, such as the reinforcing rods 42*a* and 42*b*.

Figure 9C:
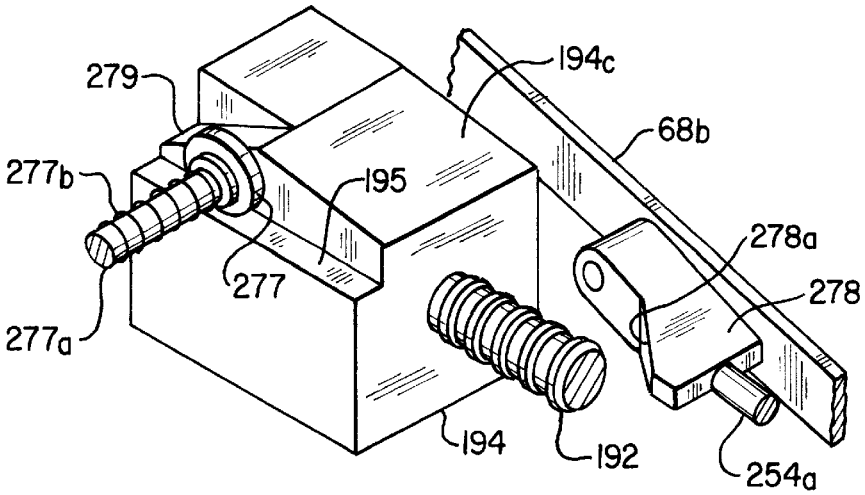
FIGS. 9A, 9B and 9C are detail views of portions of the control system shown in FIG. 9.
Figures 9, 9A, 9B:
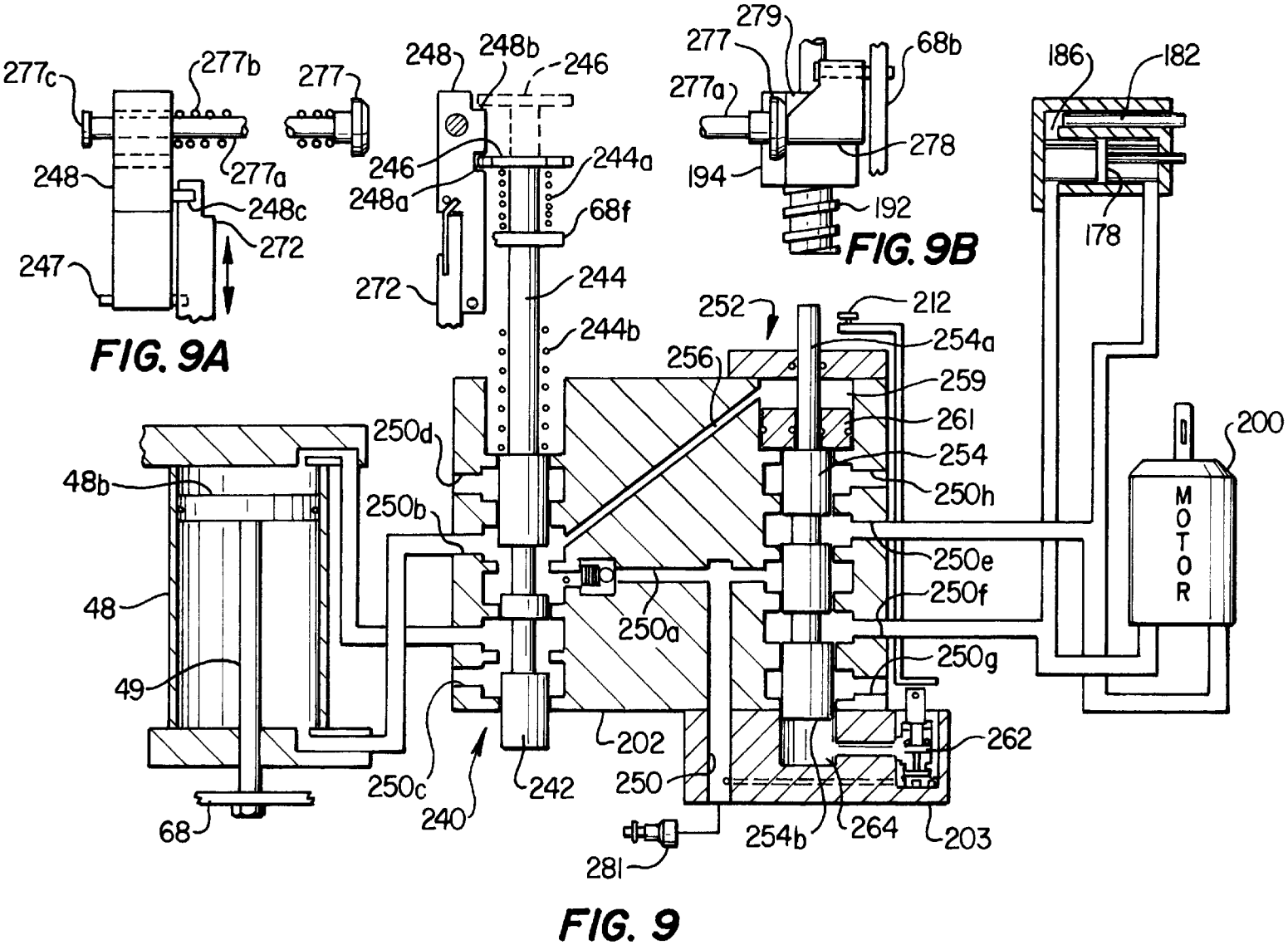
FIG. 9 is a schematic diagram of a control system for the apparatus shown in FIGS. 1–8.

Referring now to FIGS. 3 and 9, two control valves, FIG. 9, are supported on the apparatus 30 and are suitably housed in frame block portion 202 and an ancillary body portion 203, see FIG. 6A also. One of the valves is generally designated by the numeral 240 and comprises an axially shiftable spool member 242 including an extension rod part 244 which extends through a lateral projection 68*f*, FIG. 3, of the yoke arm 68*c*. Coil biasing springs 244*a* and 244*b* are sleeved around the spool extension rod 244. The distal end of spool extension rod 244 includes a generally circular flange 246 formed thereon and engageable with a latch member 248 pivotally mounted on block 202, FIG. 5B, by a pivot pin 247. Latch member 248 is also yieldably biased into the position shown in FIG. 9 by a suitable spring, not shown. Pressure air is supplied via a passage 250 to valve 240 which controls the operation of actuator 48.

A second valve 252 includes an axially shiftable spool 254 also mounted in the support block 202. A passage 256 interconnects valves 240 and 252 and passage 250*a* supplies pressure air to the spool cavities of the respective valves 240 and 252. Valve spool 242 is provided with conventional spaced apart lands, as shown in FIG. 9, and is shiftable from the position shown in FIG. 9, wherein pressure air is supplied via passage 250*b* to act on piston 48*b* to extend the yoke 68 to open the wire guide member 56 while the opposite end of the cylinder chamber in which piston 48*b* is disposed is vented to atmosphere through a passage 250*c*. When spool 242 is shifted upwardly, viewing FIG. 9, pressure air is supplied to cause the actuator 48 to extend its piston rod 49 to retract the yoke 68 to close the guide member 56 to the position shown in FIG. 5A and reduce a biasing force on the abutment 90.

In the position of the spool 242 shown in FIG. 9, pressure air is also supplied by way of passage 256 to a chamber 259 to act on a centering piston 261 for spool 254 to position the spool, as shown, whereby pressure air is blocked from flowing from passage 250 to either port 250*e* or 250*f* operably connected to reversible motor 200. A pilot valve 262 is operable to receive pressure air from the passage 250 and supply pressure air to a chamber 264 to act on spool and face 254*b* to bias spool 254 upwardly, viewing FIG. 9. In the position of pilot valve 262 shown in FIG. 9, the valve is closed to prevent communication of pressure air to the chamber 264. Spool 254 also includes conventional spaced apart lands, as shown in FIG. 9, to block fluid flow or allow flow between passage 250 and ports 250*e* and 250*f*. Valve 252 also includes exhaust ports 250*g* and 250*h*.

When a spring biased trigger 270, FIG. 1, on grip 52 is actuated a link 272, FIG. 6A and FIG. 9, is actuated to cause latch 248 to pivot out of the position shown in FIG. 9 holding ring 246 in groove 248*a* and spool 242 in the position shown whereby spring 244*a* shifts the spool 242 to a position to supply pressure air to actuator 48 to extend its piston rod 49 from actuator 48 and cause yoke 68 to move the guide member 56 to the closed position of FIG. 5A. Latch 248 carries a roller 277 thereon which is engageable with the nut 194 and with a pawl 278, FIGS. 3 and 9, which is pivotally mounted on arm 68*b*. Pawl 278 is operable to engage extension rod part 254*a* of spool 254 and to allow roller 277 to move into engagement with a ramp 279 on lead screw nut 194. FIGS. 9A and 9B are detail plan views of portions of the control elements for apparatus 30 and are intended to be read in conjunction with FIG. 9. FIG. 9C is a detail perspective view showing certain features of the timing nut 194 and the manner in which it interacts with the roller 277 and pawl 278. Roller 277 is mounted on a shaft 277*a*, FIGS. 9A and 9C, which is supported on and is axially slidable relative to latch 248. A coil spring 277*b* biases the roller 277 toward the timing nut 194, FIG. 9C, and a hub 277*c*, FIG. 9A, limits movement of the roller away from the latch member. Pawl 278 which is pivotally supported on arm 68*b* includes a cam surface 278*a* engageable with roller 277 to move the roller to a position on a ledge 195 on timing nut 194. However, when pawl 278 has moved away from the timing nut 194, such as to the position shown in FIG. 9C, and the nut 194 has translated to a position out of engagement with the roller 277, the roller may move axially to a position such that upon movement of the timing nut back to the positions shown in FIGS. 9B and 9C, the roller will move up the ramp 279 to pivot latch 248 out of engagement with the flange 246. Upon movement of the pawl 278 toward the roller 277, cam surface 278*a* will engage the roller and move it off of ramp 279 and back onto ledge 195 to allow latch member 248 to assume the position shown in FIG. 9.

The operation of apparatus 30 will now be described. It will be assumed that wire 102 has been fed into and through the guide tubes 104 and 108 and is cut of f at the distal end face 108*a* preparatory to an operating cycle of the apparatus. The wire twist member 220 is in a home position, as shown in FIG. 4, and the wire guide member 56 is open also in the position of FIG. 4. When the apparatus 30 is placed in communication with a source of pressure air, not shown by way of a quick disconnect connector member 281, FIG. 9, and applied to a workpiece such as the crossed bars 42*a* and 42*b*, pressure air is supplied to actuator 48 to hold the wire guide member 56 in the open position, that is with the yoke 68 extended to the right, viewing FIG. 1, so that the wire guide member 56 is open and the abutment 90 is in a position ready to yieldably engage a workpiece.

Referring further to FIG. 9, the control components for the apparatus 30 are shown in a position wherein piston rod 49 of actuator 48 is retracted into the actuator to position the yoke 68 so that the guide member 56 is open and the abutment 90 is yieldably biased away from frame plate 44. When trigger 270 is actuated, link 272 engages a pin 248*c* to pivot pawl 248 to release engagement with ring 246 in groove 248*a*. Spring 244*a* acts on spool 242 to shift it to a position to effect flow of pressure air to the opposite end of actuator 48 to cause piston rod 49 to extend from the actuator and to move yoke 68 to close the guide member 56 and clamp a work piece or work pieces between the guide member and the abutment 90.

When the yoke 68 moves toward the grip 52, closing the guide member 56, the bias force acting on the abutment 90 by the springs 100 is reduced and the abutment 90 moves to a retracted position closely adjacent to the twist member 220. As the yoke 68 moves to the position to close the guide member 56, the projection 68*f* engages spring 244*b* to bias the spool 242 to the opposite working position. However, spool 242 is maintained in the first-mentioned position by engagement of latch 248 with ring 246 at a groove 248*b*. As yoke 68 moves to the position shown in FIGS. 3 and 5A to effect closure of the guide member 56, pawl 278 engages the rod part 254*a* of spool 254 shifting valve 252 to a position to apply pressure air to motor 200 by way of passage or port 250*e* and exhaust spent air via parts 250*f* and 250*g*. Motor 200 rotates in one direction while piston 178 is biased by pressure air to disengage clutch member 170 from clutch member 168. In this operating condition, pressure air supplied to motor 200 effects rotation of shaft 116*b* through the speed reduction gear drives 198*a* and 198*b* driving gear 152 and gear 166.

If the twist member 220 is not in its starting or "home" position at the beginning of an operating cycle, cam 114 and cam follower 113 will have displaced support member 110 and guide member 108 out of their working position for receiving and feeding wire toward the guide member 56. In this condition, finger 110*c* will be engaged with tab 174*a* on shifter fork 174 causing the shifter fork to hold clutch member 170 in engagement with clutch member 168. Even though the motor 200 is rotating shaft 116*b* in a clockwise direction, viewing FIG. 4, the clutch 168, 170 will be engaged until twist member 220 moves to its home position, which position will also be a position of cam 114 which will allow the support member 110 to move downward, viewing FIG. 5A, under the urging of pressure fluid acting on piston 178 and thus allowing clutch members 168 and 170 to disengage. However, prior to this action, pawl 175, FIG. 6B, is also biased to engage gear 210 to prevent rotation of shaft 190 and movement of timing nut 194 before the twist member 220 is in its home position. Thus, if twist member 220 is not in its home position and support member 110 is not in a position for feeding wire through guide 108, shaft 190 will be locked against rotation and the slip clutch formed between hub 206, gear 188 and hub 204 will allow rotation of the gear so that the motor 200 can rotate momentarily with clutch 168, 170 engaged to position twist member 220 in its home position. Once twist member 220 and cam 114 have reached the home position, clutch members 168 and 170 will disengage urging shifter fork 174 downward, viewing FIGS. 5A and 6B, and pawl 175 will be moved to disengage from gear 210, thus allowing rotation of shaft 190 to commence and start timing nut 194 on its travel, to the left, viewing FIG. 6A.

Gear 152 drives gear 144 and gears 134 and 136 through clutch members 139 and 140 to rotate the wire feedwheels 118 and 120 to feed wire through the guide member 56 and through the slots 226*a* and 226*b* in the wire holder and drag plate 226 until a predetermined length of wire is fed in a generally left sideways-facing U-shaped configuration, viewing FIG. 5A.

As the motor 200 drives the mechanism described above, gear 166 is driving gear 188 and lead screw 192 causing timing nut 194 to move to the left, viewing FIG. 6A, and downwardly viewing FIG. 9B. As the timing nut 194 advances toward the valve 252, it moves out of engagement with roller 277 and then eventually it engages pawl 278 at cam surface 194*c*, FIG. 9C, moving this pawl out of engagement with spool rod part 254*a*. Nut 194 also then engages link 212 to effect shifting of valve 262 to a position to allow pressure air into chamber 264, FIG. 9. Since spool 242 has shifted to a position to vent chamber 259 and passage 256 to atmosphere pressure air supplied to chamber 264 will shift spool 254 to a position to apply pressure air to motor 200 by way of port 250*f*, while spent air exhausts through port 250*h*, to rotate the motor in the opposite direction and to cause pressure air to shift actuator piston 178 upwardly, viewing FIG. 5A, to bring clutch member 170 into engagement with clutch member 168. Actuator piston 182 also moves to a position to hold member 110 and cam follower 113 out of engagement with cam 114 once wire cutoff has occurred. Motor 200 now drives shafts 116*a* and 116*b* through speed reduction gear drives 198*a* and 198*b* to rotate twister member 220 and cam 114. Cam 114 engages cam follower 113 almost immediately shifting the wire guide support member 110 upwardly, viewing FIG. 5A, to effect cutoff of a predetermined length of wire extending from the distal end face 108*a* of wire guide 108. As wire guide support member 110 moves upwardly, viewing FIG. 5A, shifter fork 148*a* effects disengagement of clutch member 140 from clutch member 139, thereby ceasing rotation of the feedwheels 120 and 118. Twist member 220 is thus rotated after cutoff of a predetermined length of wire, to impart a predetermined number of twists or wraps of the wire ends around each other to secure a wire tie to a workpiece or workpieces.

As the motor 200 effects rotation of shaft 116*a*, 116*b* and the twist member 220, in a counterclockwise direction, viewing FIG. 4, the timing nut 194 is now moving in the opposite direction along the lead screw 192 to the right, viewing FIG. 6A and to the left viewing FIG. 9C, and, as the timing nut reaches a predetermined position it will engage roller 277 at ramp 279 to cause latch 248 to pivot to release ring 246 from engagement with groove 248*b* to allow spool 242 to move in the opposite direction under the urging of spring 244*b*. Spool 242 will then shift to the position shown in FIG. 9 to cause pressure air to flow to actuator 48 to effect retraction of piston rod 49 into the actuator and movement of the yoke 68 to open the guide member 56 and to urge the abutment 90 and workpiece engaged therewith away from the twist member 220 to assure that the distal ends of the wire tie are clear of the twist member and the wire holder and drag member 226.

When valve spool 242 returns to the position shown in FIG. 9 pressure air is supplied by way of passage 256 to chamber 259 to cause the centering piston 261 to shift the spool 254 back to the position shown in FIG. 9 to effect shut off of pressure air to the motor 200. As the yoke 68 moves to the position to open the guide member 56, pawl 278 engages roller 277 and biases it off of ramp 279 back on to the ledge 195 in the position shown FIG. 9C. This action occurs before projection 68*f* has compressed spring 244*a*. Accordingly, latch 248 is operable to pivot to the position to engage flange 246 in groove 248*a*, the position shown in FIG. 9, before spring 244*a* is compressed to urge the spool to move upwardly, viewing FIG. 9. In this way the latch member 248 may operate to retain the spool 242 in the desired working positions described above.

Figure 10A:
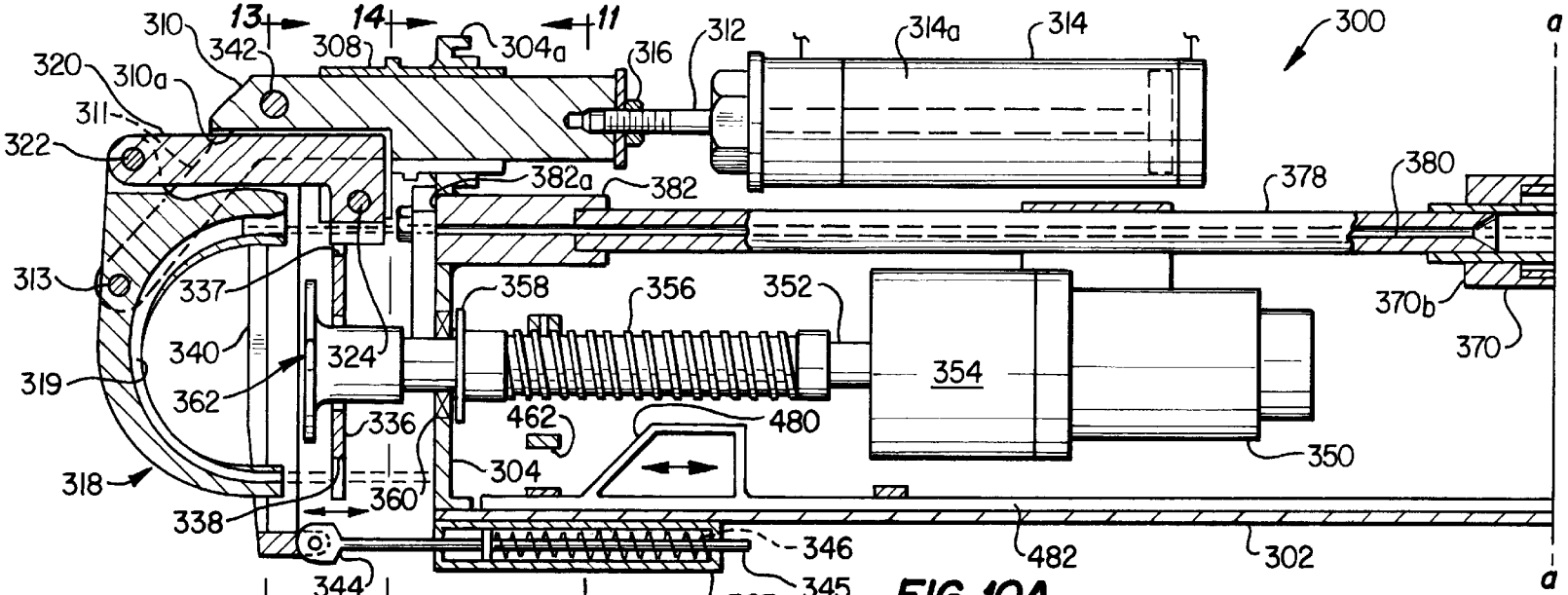
FIGS. 10A and 10B comprise a longitudinal central section view of an alternate embodiment of an apparatus in accordance with the invention.
Figure 10B:
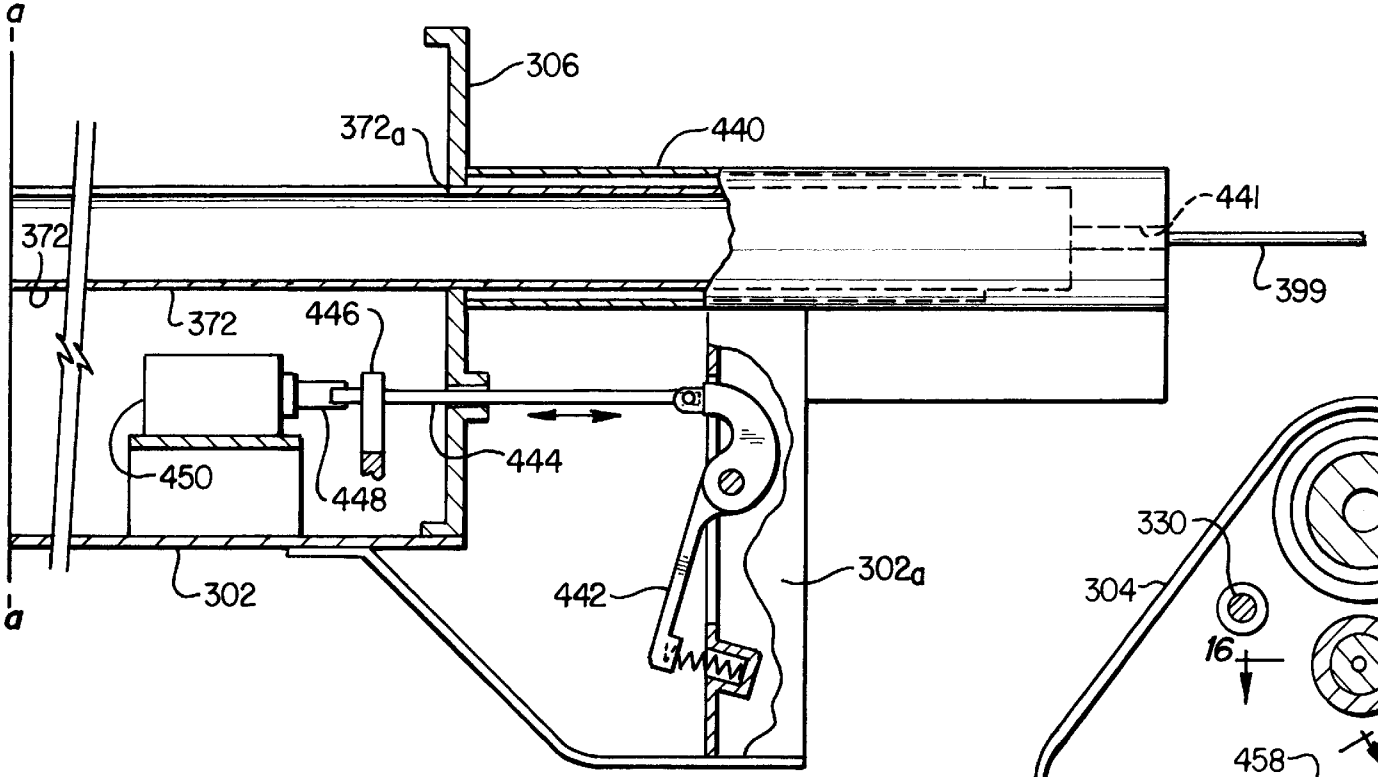
Figure 13:
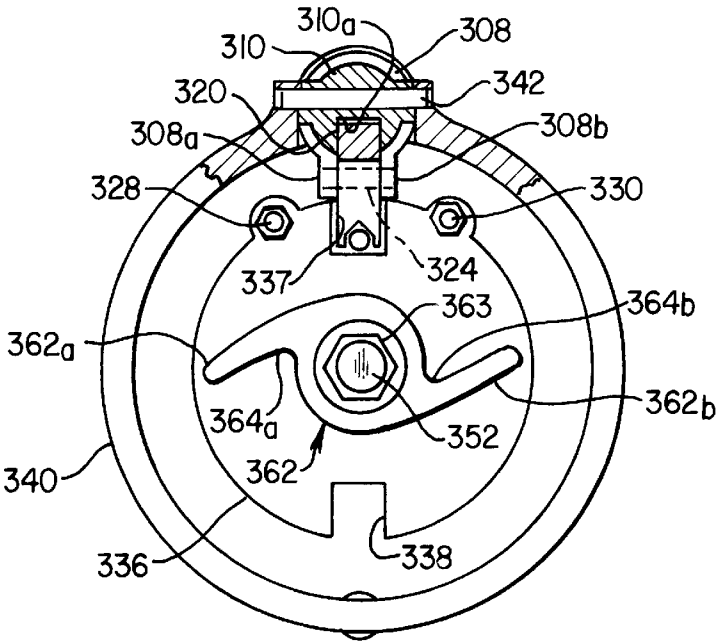
FIG. 13 is a view taken generally from the line 13—13 of FIG. 10A.

Referring now to FIGS. 10A and 10B, an alternate embodiment of a wire tying apparatus in accordance with the invention is illustrated and generally designated by the numeral 300. The apparatus 300 includes a frame comprising an elongated curved plate frame member 302 secured to a first transverse end plate 304, FIG. 10A, and a spaced-apart second end plate 306, FIG. 10B. As shown in FIG. 10A and FIG. 13, end plate 304 includes a boss 304*a* for supporting an axially extending tubular sleeve 308 suitably secured thereto and forming a bearing for an elongated, generally cylindrical actuator rod member 310. Actuator member 310 is connected at one end to a piston rod 312 of a cylinder and piston-type actuator 314. The distal end of the piston rod 312 is threadedly connected to the one end of actuator member 310 and an adjustable lock nut 316 locks the two members together in a selected working position relative to each other. Actuator member 310 includes downward and forward projecting clevis-like arm portions 311, one shown in FIG. 10A, for supporting a wire guide member 318, substantially like the guide member 56, for pivotal movement about a pivot pin 313 between a closed position, as shown in FIG. 10A, and an open position, not shown.

A link 320 is pivotally connected to guide member 318 at a pivot connection 322 and to the support member 308 at a pivot pin 324, see FIG. 13 also. Bearing and support member 308 includes opposed depending clevis arm portions 308*a* and 308*b*, FIG. 13, for supporting the pin 324 with the link 320 disposed therebetween. Actuator member 310 includes an axially extending slot 310*a* formed therein to provide clearance for link 320. Accordingly, one end of the link 320 is secured to the frame 302 by way of the member 308 but is operable to provide for pivotal movement of the guide member 318 between a closed or working position and an open position in a manner substantially like the operation of the guide member 56 described above.

Figure 17:
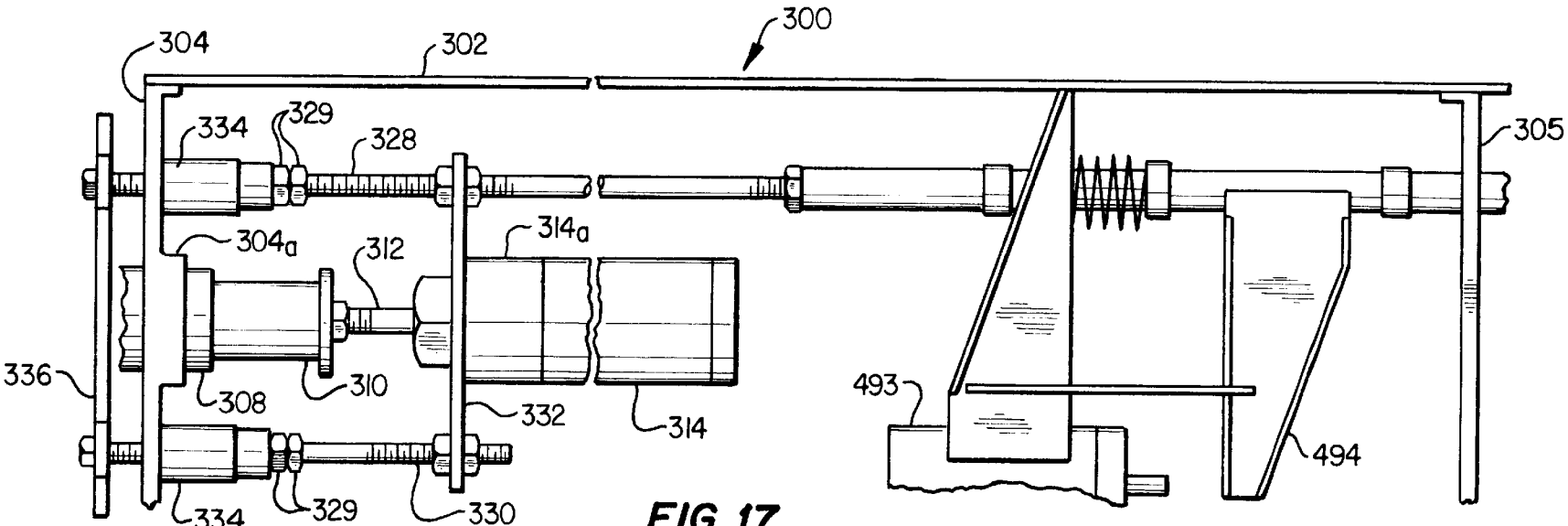
FIG. 17 is a partial top plan view of the embodiment shown in FIGS. 10A and 10B.

Referring briefly to FIG. 17, actuator 314 is also operably connected to spaced apart linearly movable rods 328 and 330 which are connected at one end to a transverse member 332 mounted on the cylinder part 314*a* of actuator 314 and movable therewith. Actuator rods 328 and 330 project through suitable tubular sleeve bearing members 334 mounted on frame endwall 304, extend through endwall 304 and are connected to a moveable wire holder and drag plate member 336. Wire holder plate 336 includes opposed, radially projecting slots 337 and 338, as shown in FIG. 13, and in this respect is configured similar to the wire holder plate 226 of the apparatus 30. However, in the apparatus 300 the wire holder plate 336 is moveable axially toward and away from the frame endwall 304 during certain portions of an operating cycle of the apparatus 300 to be explained in further detail herein. As shown in FIG. 17, the forward limit position of plate 336 with respect to end well 304 and a wire twist member of apparatus 300 is adjustable by lock nuts 329 mounted on threaded portions of rods 328 and 330.

Referring further to FIGS. 10A and 13, the apparatus 300 also includes a generally circular ring-type abutment member 340 for engaging a workpiece, or workpieces, to allow clamping of the workpieces between the abutment 340 and the guide member 318. However, the circular ring abutment member 340 is mounted on the actuator member 310 and is pivotally connected thereto by a pivot pin 342, as shown in FIG. 13, in particular. The abutment member 340 is connected to a link 344 diametrically opposite the pin 342, FIG. 10A. Link 342 includes an elongated rod part 345 which extends through a sleeve part 303 of frame 302 and is engaged with a coil spring 346 disposed therein for yieldably biasing the abutment member 340 toward the guide member 318.

Pivotal movement of the abutment member 340 about the pivot pin 342 in a clockwise direction, viewing FIG. 10A, is limited by cooperating stop surfaces on the actuator member 310 and the abutment member 340, not shown. In this way the abutment member 340 will normally be maintained in a position as shown in FIG. 10A which will prevent further clockwise movement of the member 340 about pivot pin 342, viewing FIG. 10A, but will permit movement in the opposite direction against the bias of spring 346. Accordingly, in response to applying pressure air to actuator 314 in a direction which will retract piston rod 312 into the cylinder 314*a*, guide member 318 will move to the position shown in FIG. 10A while at the same time wire holder plate 336 will be moved toward the guide member 318.

Referring further to FIGS. 10A and 13, the apparatus 300 also includes a pressure air operated drive motor 350 suitably mounted on the frame 302 and driveably connected to a rotary shaft 352 through a speed reduction gear drive 354. Shaft 352 includes a helical lead screw 356 formed thereon. A somewhat arcuate cam 358 is also supported on and rotatable with shaft 352. Shaft 352 is mounted in a suitable bearing 360 supported on endwall 304 and the distal end of shaft 352 is adapted to support and be driveably connected to a rotary wire twist member 362 by suitable fastener means, such as a hex nut 363, FIG. 13. Wire twist member 362 includes opposed radially projecting hook portions 362*a* and 362*b* including respective concave recesses 364*a* and 364*b* for engaging opposite ends of a length of wire to be twisted together in substantially the same manner as the wire twist or hook member 220 of apparatus 30.

Accordingly, when wire guide member 318 is placed in a working position, as shown in FIG. 10A, and wire is fed through groove 319, which is configured similar to the groove 76 of the guide member 56, opposite ends of the wire are disposed in opposed, radially projecting grooves or slots 337 and 338 of the wire holder and drag plate 336, particularly when it is moved directly adjacent to the twist member 362, as shown in the position in FIG. 10A. However, when actuator 314 is energized to extend piston rod 312 from cylinder 314*a*, guide member 318 is moved away from twist member 362 to an open workpiece receiving position and wire holder and drag member 336 is also moved away from the twist member 362 toward the endwall 304.

Figure 16:
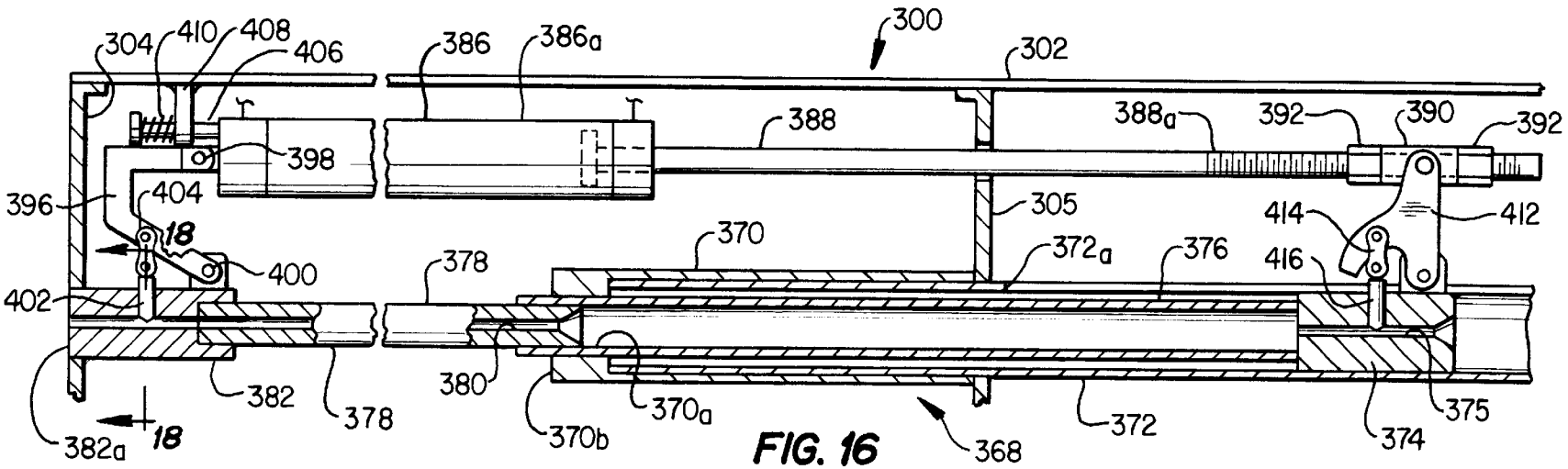
FIG. 16 is a section view taken from the line 16—16 of FIG. 11.

Referring further to FIGS. 10A, 10B and 16, the apparatus 300 includes a wire feed mechanism 368 comprising an elongated support tube 370 mounted on an intermediate transverse frame wall 305 supported by frame number 302 and operable to support an elongated guide tube 372 for a cylindrical wire feed clamp 374 slidably disposed therein. Guide tube 372 is partially sleeved within and secured to the support tube 370 in a suitable manner. A movable wire guide tube 376 extends within tube 372, is connected at one end to the wire feed clamp 374 and projects through and is slidably disposed in a bore 370*a* formed in a transverse end well 370*b* of tube 370. Guide tube 376 is sleeved over a second wire guide tube 378 having a wire guide passage 380 formed therein. Tube 378 is secured to a boss 382 which is suitably mounted on the endwall 304.

An elongated cylinder and piston type pressure fluid actuator 386 includes an extensible piston rod 388 which is connected adjacent its distal end to a sleeve member 390 disposed between adjustable locknuts 392 which are threadedly engaged with a threaded portion 388*a* of piston rod 388. The working position of sleeve member 390 may be adjusted on rod 388 to predetermine the length of wire fed to wire guide member 318. The opposite end of actuator 386 is connected by way of a somewhat C-shaped link 396 to the boss 382 by pivot pins 398 and 400, respectively. Link 396 is also operably connected to a wire clamp pin 402 supported in a transverse bore in boss 382. A link 404 partially interconnects the link 396 with the pin 402. Wire clamp pin 402 is axially moveable into the passage 380 to clamp wire at the pin in response to actuation of the actuator 386. The end of the actuator 386 connected to link 396 also includes a guide rod 406 extending therefrom and supported for sliding movement in a boss 408. A coil spring 410 is sleeved over rod 406 and is operable to bias the actuator 386 to the left, viewing FIG. 16, to urge clamp pin 402 to engage a wire in passage 380 when pressure air is not acting on actuator 386.

Referring further to FIG. 16, the sleeve member 390 is pivotally connected to a link 412, which link is also pivotally connected to the wire feed clamp 374 and a wire clamp pin 416 by way of a link 414. Clamp pin 416 is disposed for reciprocal movement in a bore 375 formed in the guide and clamp member 374. An elongated axially extending slot 372*a* is formed in guide tube 370 to form clearance for links 412 and 414. Wire to be operated on by the apparatus 300 may be extended from a source, not shown, through the passage 375 and passage 380 and, in response to operation of the actuator 386 to retract the piston rod 388 into the cylinder 386*a*, wire is clamped by pin 416 through actuation of the links 412 and 414 and as the wire feed clamp 374 slides within tube 372 to the left, viewing FIG. 16, wire is advanced through the passage 380 and beyond the distal end 382*a* of boss 382.

When the actuator 386 is moved in the opposite direction to extend piston rod 388, to the right, viewing FIG. 16, pivot links 412 and 414 retract the wire clamp pin 416 out of forcible engagement with wire disposed in the wire feed clamp 374 while links 396 and 404 cause the clamp pin 402 to engage wire in passage 380 at the boss 382 to prevent movement of the wire relative to the boss. Moreover, when pressure air is not applied to the actuator 386 the spring 410 will bias the actuator cylinder member 386*a* and the links 396 and 404 to clamp wire in boss 382 by way of the pin 402.

Figure 14:
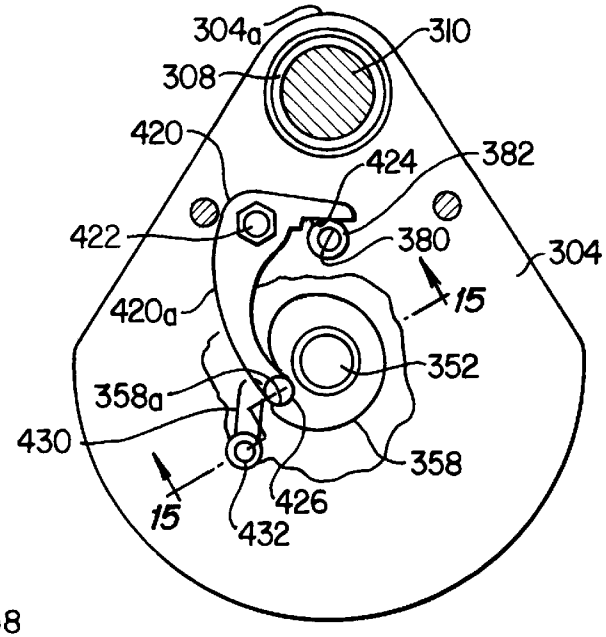
FIG. 14 is a view taken generally from the line 14—14 of FIG. 10A.
Figure 15:
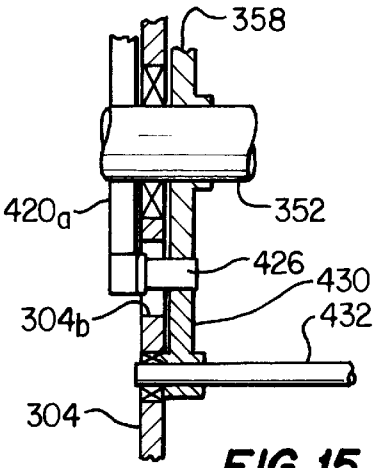
FIG. 15 is a detail section view taken from the line 15—15 of FIG. 14.

Referring now to FIGS. 14 and 15, a predetermined length of wire is cut at the end face 382*a* by a wire cutter 420 pivotally mounted on the endwall 304 by a pivot pin 422. Cutter 420 includes a wire cutter edge 424 disposed adjacent the face 382*a* of boss 382. The wire cutter 420 also includes a lever arm 420*a* and a cam follower 426 disposed thereon and engageable with the cam 358 whereby, in response to rotation of the shaft 352 in a counterclockwise direction, viewing FIG. 14, the wire cutter 420 will cause the cutting edge 424 to move across the passage 380 at the face 382*a* to effect cutoff of a wire protruding therefrom. Cam 358 includes a notch 358*a* which firmly engages the cam follower 426 to allow shaft 352 to seek a "home" position for the cam and for the wire twist member 362.

As shown in FIG. 15, cam follower 426 is supported on lever arm 420*a* and projects through a suitable opening 304*b* in endwall 304. A lever arm 430 is mounted on a control shaft 432, FIGS. 14 and 15, which control shaft will be described in further detail herein. Lever arm 430 is biased to engage cam follower 426 to hold the cutter 420 in the position shown in FIG. 14 but may move to an alternate position so that the cam follower 426 is held out of engagement with the cam 358 during the wire twisting portion of an operating cycle of the apparatus 300.

Figure 18:
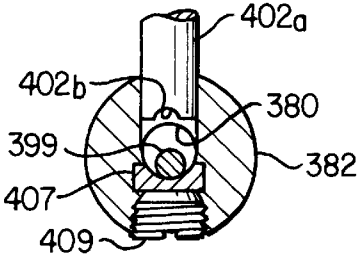
FIG. 18 is a detail section view taken from the line 18—18 of FIG. 16.

Referring briefly to FIG. 18, a modified wire clamp pin 402*a* is shown disposed in the boss 382 whereby the boss is also modified to include a removable hard surfaced wire clamp jaw 407 which is retained in a working position, as shown, by a removable set screw 409. In this way the contact point of clamping wire within the boss 382 may be provided by a hard surface member which may be replaced, when worn from repeated clamping and releasing operations. Modified clamp pin 402*a* includes an arcuate recess 402*b* formed therein for engagement with wire extending within the passage 380, which wire is indicated at 399 in FIG. 18. Wire clamp member 374 and clamp pin 416 may be similarly modified.

Figure 12:
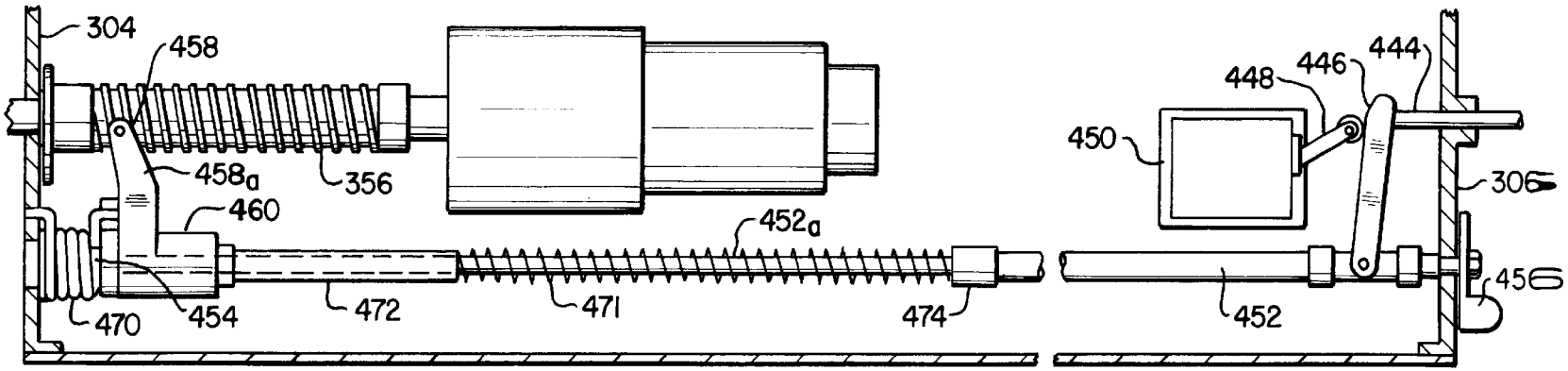
FIG. 12 is a view taken generally from the line 12—12 of FIG. 11.
Figure 11:
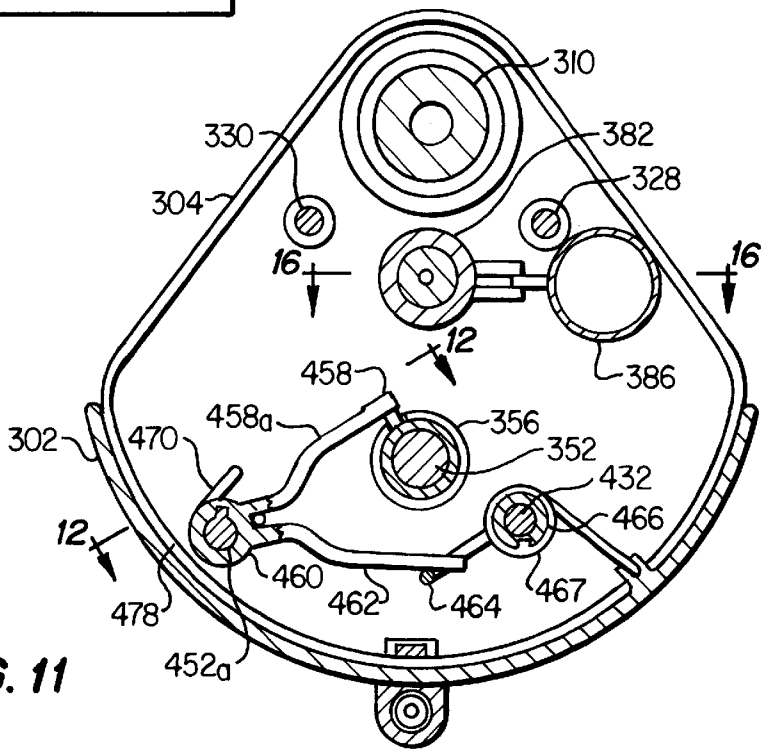
FIG. 11 is a section view taken generally from the line 11—11 of FIG. 10A.

Referring now to FIGS. 10B, 11 and 12 the frame 302 includes a hand grip 302*a* disposed adjacent and connected to a tubular shroud and support 440 for a portion of the wire guide tube 372, including a wire feed port 441, wherein wire 399 is admitted to the feed mechanism including the wire feed clamp 374, not shown in FIG. 10B. An actuating trigger 442 is pivotally mounted on grip 302*a* and is operable to be digitally actuated to move a trigger extension rod 444 to engage a link 446 which is operable to be disposed between rod 444 and an actuator member 448 for a control valve 450 mounted on frame member 302. As shown in FIG. 12, link 446 is mounted on an elongated rod 452 supported between endwalls 304 and 306 for pivotal movement about its longitudinal axis. Rod 452 includes a hub portion 454 supported for pivotal movement relative to endwall 304. The opposite end of rod 452 is supported by endwall 306 and includes an actuator lever 456 secured thereto. A lead screw follower 458, FIGS. 11 and 12, is engageable with the lead screw 356 and is supported on a hub 460.

Hub 460 includes a radially projecting arm 458*a*, FIG. 11, supporting lead screw follower 458 and a second circumferentially spaced radially projecting arm 462 engageable with a generally U-shaped bail 464 supported on a pivot shaft 466 which in turn, is journaled for rotation on shaft 432. Hub 460, FIG. 12, is axially slidable on a reduced diameter portion 452*a* of shaft 452 and is suitably keyed to the shaft for rotation therewith about the longitudinal central axis of the shaft. Hub 460 and lead screw follower 458 are also yieldably biased into the position shown in FIG. 12 by a torsion coil spring 470 disposed in sleeved relationship on shaft hub 454 and having opposed ends suitably connected to endwall 304 and hub 454, respectively. Torsion spring 470 is operable to bias the lead screw follower 458 into engagement with the lead screw 356. However, in response to rotation of the shaft 466 and the bail 464, acting on the arm 462, the follower 458 may be rotated out of engagement with the lead screw 356. A coil compression spring 471 is sleeved over shaft portion 452*a* between a tubular extension 472 of hub 460 and a collar 474 on shaft 452 for biasing lead screw follower 458 axially along shaft 452 to the position shown in FIG. 12.

Referring briefly to FIG. 10A, an axially adjustable ramp 480 is mounted on frame member 302 and includes an elongated actuator stem 482 which extends to a suitable position to be actuated by a person operating the apparatus 300 to adjust the number of twists applied to a length of wire by the twist member 362. Ramp 480 is operable to be engaged by arm 462 as the follower 458 moves during engagement with lead screw 356, axially toward the motor and gear reduction unit 350, 354, viewing FIGS. 10A and 12. Arm 462 is engageable with ramp 480 to pivot hub 460 and follower 458 out of engagement with the lead screw at a predetermined position. Such movement will effect pivotal movement of shaft 452, 452*a* and link 446 out of engagement with valve actuator 448 and trigger extension rod 444 whereby valve 450 will effect shut-off of motor 350 as will be explained in further detail herein. Once follower 458 has been pivoted out of engagement with the lead screw 436 spring 471 will move the follower along shaft 452*a* back to the position shown in FIG. 12 and torsion spring 470 will bias the hub 460 and follower 458 back to engagement with lead screw 356. Shaft 452, 452*a* is rotated to reposition link 466 between trigger extension rod 444 and valve actuator 448.

Figure 19:
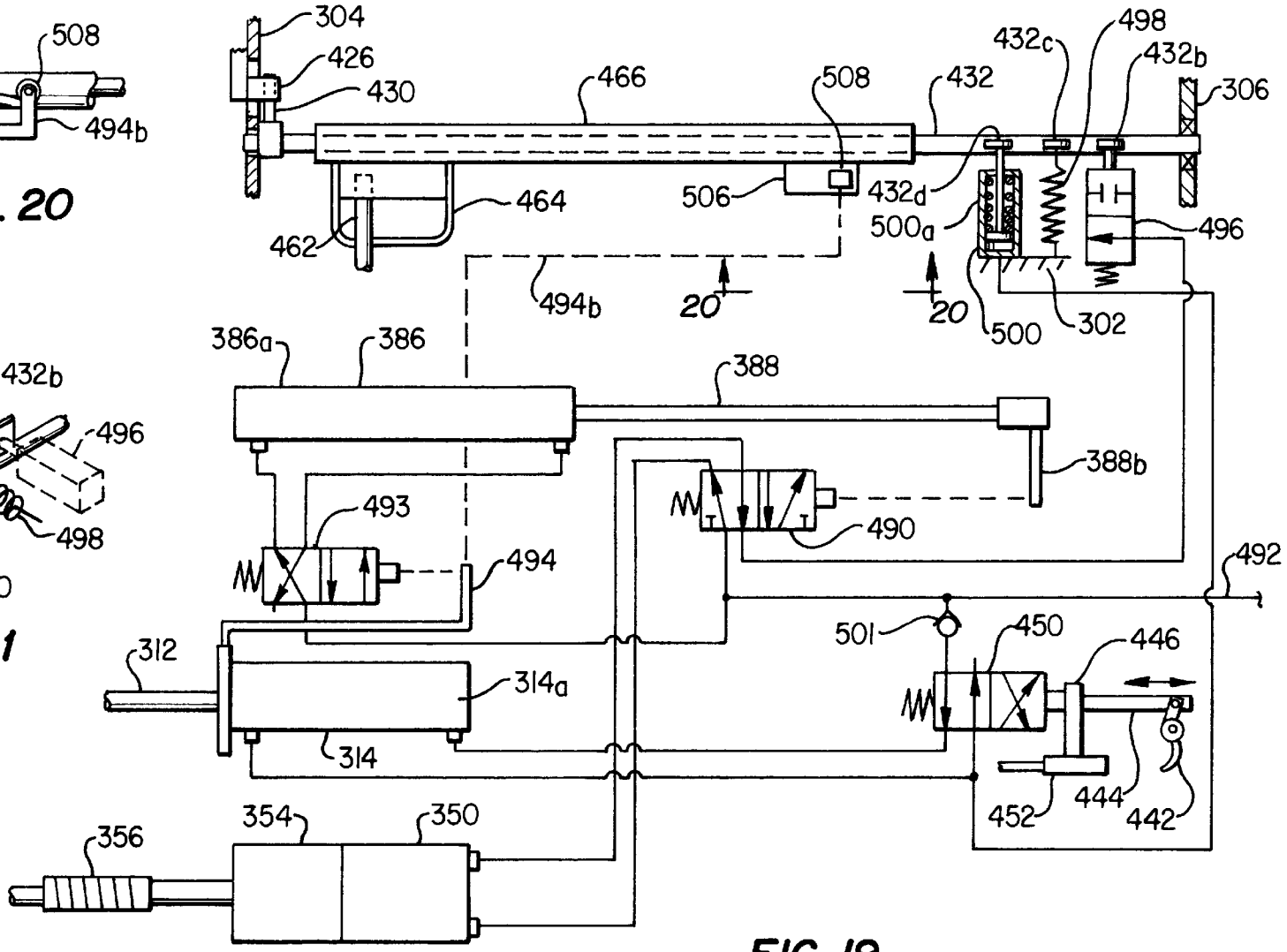
FIG. 19 is a diagram of a control system for the apparatus shown in FIGS. 10 through 18.
Figure 20:
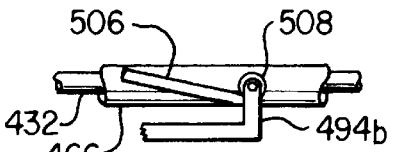
FIG. 20 is a detail view taken from the line 20—20 of FIG. 19.
Figure 21:
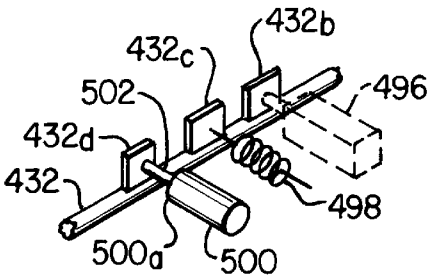
FIG. 21 is a detail perspective view of certain elements of the control system shown in FIG. 19.

Referring now to FIGS. 19 through 21, a control system for operating the apparatus 300 is illustrated generally in schematic form. The control system includes the valve 450, which is spring biased into one position and is mechanically actuated by the linkage 444, 446 to move to the other position indicated by the valve symbol. A motor control valve 490 is operable, together with valve 450, to receive pressure air from a source, not shown, by way of a conduit 492. Valve 490 is spring biased into a position to provide pressure air to rotate motor 350 in a direction opposite to the direction which the motor rotates to effect a wire twisting operation and valve 490 is mechanically actuated by a member 388*b* connected to piston rod 388 to move to a position to supply pressure air to motor 350 to rotate in a forward direction to effect application of a twisted wire tie to a workpiece. A third valve 493 is spring biased into a position to supply pressure air to extend piston rod 388 from cylinder 386*a* of actuator 386. Valve 493 is also mechanically actuated to a second position by a link 494 which is operably connected to the actuator cylinder 314*a* for movement therewith.

Referring further to FIGS. 19 and 21, a fourth valve 496 is operably connected to valve 490, is spring biased into a position to allow fluid to flow through the valve, and is mechanically actuated by a tab 432*b* projecting radially from shaft 432 to a position to block the flow of pressure fluid through the valve. Valve 496 is suitably mounted on frame member 302. Second and third radially projecting tabs 432*c* and 432*d* are supported on shaft 432 and are connected, respectively, to a tension spring 494 and a cylinder and piston actuator 500 having a piston rod 502 extending from a cylinder 500*a*. Cylinder 500 is operable to extend its piston rod from cylinder 500*a* in response to pressure fluid being applied thereto and cylinder 500*a* includes a spring disposed therein for retracting piston rod 502 into cylinder 500*a*.

Referring further to FIG. 19 and FIG. 20 the tubular shaft 466 includes a ramp 506 extending radially from the axis of rotation of the shaft and engageable with a cam follower 508 mounted on an extension 494*b* of link 494. As shown in FIG. 19, cylinder actuator 500 is operably connected to valve 450 and, together with spring 498, is suitably fixed at one end to frame member 302.

An operating cycle of the apparatus 300 will now be described. Initially, prior to the start of an operating cycle, wire 399 will be fed through the feed mechanism 368 so that wire extends through the wire clamp 374 and boss 382 and has been cutoff even with endface 382*a*. With pressure air supplied by way of conduit 492 to valves 450, 490 and 493, pressure air flows by way of a check valve 501, FIG. 19, through valve 450 to actuator 314 to hold the actuator in an extended position of piston rod 312 whereby guide member 318 is in an open position and wire holder and drag plate 336 is moved away from twist member 362 toward endwall 304. Cam follower 494 is also not in forceable engagement with ramp 506. However, shaft 466 is suitably connected to a torsion coil spring 467, FIG. 11, which is also connected to frame member 302 and is operable to rotate shaft 466 and bail 464 in a clockwise direction, viewing FIG. 11, to disengage lead screw follower 458 from lead screw 456.

In the position of valve 490 at the start of an operating cycle, pressure air is applied to motor 350 to cause the motor to rotate shaft 352 in a clockwise direction, viewing FIG. 14, to place cam 358 in engagement with the cam follower 426 in a home position of cam 358 as well as shaft 352 and twist member 362, such home position being that shown in FIGS. 13 and 14. Spring 498 biases shaft 432 and lever arm 430 to urge the cam follower 426 into the position shown in FIG. 14. If twist member 362 is not in its home position arm 420*a* of cutter 420 will be biased in a clockwise direction, viewing FIG. 14, to effect rotation of shaft 432 such that tab 432*b* has not actuated valve 496 and pressure fluid may be vented through this valve thus allowing motor 350 to rotate shaft 352 in a reverse direction until cam follower 426 moves into recess 358*a* whereby, in this position, shaft 432, under the urging of spring 498 will rotate to cause valve 496 to stop the flow of pressure fluid exhausting from motor 350 through valve 490, thus stopping rotation of the motor 350 in the home position of cam 358 and twist member 362. Since shaft 466 is biased by torsion spring 467 to disengage lead screw follower 458 from lead screw 356 reverse rotation of the motor 350 to the home position of twist member 362 occurs regardless of the axial position of the lead screw follower.

When link 444 moves valve 450 to its mechanically actuated position pressure air is supplied to actuator 314 to retract piston rod 312 within cylinder 314*a* thereby closing wire guide 318 to the position shown in FIG. 10A and moving wire holder and drag member 336 to a position adjacent to twist member 362, also the position shown in FIG. 10A. As cylinder actuator 314 moves to the closed position of guide member 318 linkage 494, 494*b* moves valve 493 to its mechanically actuated position to apply pressure air to cylinder actuator 386 to retract piston rod 388 into the cylinder 386. This action will cause wire clamp pin 416 to forcibly engage wire within the passage 375 while clamp pin 402 is released from forcible engagement with wire in boss 382 and thus wire is fed linearly toward and through the groove 319 in guide member 318 as the clamp member 374 translates linearly to the left, viewing FIG. 16, to advance wire through the passage 380. As link extension 494B moves to the left, viewing FIG. 20, cam follower 508 moves along ramp 506 causing shaft 466 to rotate in a counterclockwise direction, viewing FIG. 11, to rotate bail 464 out of forcible engagement with arm 462 thereby allowing lead screw follower 458 to engage the lead screw 356. Moreover, with pressure air supplied to actuator 314 in the manner just described, pressure air also flows to actuator 500 to effect rotation of shaft 432 in a counterclockwise direction, viewing FIG. 14, to cause arm 430 to move out of engagement with cam follower 426 and allow valve 496 to move to a position to allow pressure fluid to flow therethrough. This action is carried out against the bias of spring of 498.

As piston rod 388 retracts into cylinder 386*a*, actuator arm 388*b* engages valve 490 moving this valve to the mechanically actuated position to supply pressure air to motor 350 to effect rotation of shaft 352 and lead screw 356 in a counterclockwise direction, viewing FIGS. 13 and 14. As shaft 352 and cam 358 start to rotate, wire cutter 420 is actuated to cut off the preferred length of wire at the distal endface 382*a* of boss 382, bail 464 is out of position to influence the position of lead screw follower 458 and, as motor 350 continues to rotate, twist member 362 engages the opposite ends of the somewhat U-shaped piece of wire held by the wire guide member 318 to begin twisting the wire into a closure like that shown in FIG. 2.

As the ends of the length of wire exit the slots 337 and 338, drag created by engagement of the wire ends with the sides of these slots in holder and drag plate 336 properly tension the wire to form a snug closure loop and tight helical wraps. Lead screw follower 458, translates linearly along shaft 452 until arm 462 engages ramp 480, thus moving lead screw follower 458 out of engagement with the lead screw and rotating shaft 452 and link 446 out of engagement with rod 444 and valve actuator 448. Accordingly, at this time a predetermined number of helical wraps has been formed as valve 450 shifts back to the position shown in FIG. 19, causing cylinder actuator 314 to extend piston rod 312 thereby pivoting wire guide member 318 to an open position and moving wire holder and drag plate 336 away from twist member 362, to the right, viewing FIG. 10A.

As actuator 314 moves to the position described above link 494, 494*b* moves in a direction to effect movement of valve 493 to a position to extend piston rod 388 from cylinder actuator 386 back to a starting position for feeding a successive length of wire during a succeeding operating cycle. As rod 388 extends from cylinder 386*a* links 412 and 414 allow clamp pin 416 to move away from forcible engagement with the wire in passage 375 while links 396 and 404 urge pin 402 to clamp wire within the boss 382 to prevent movement of the wire away from the endface 382*a*. As piston rod 388 moves to a position to disengage arm 388*b* from valve 490, this valve shifts to the position shown in FIG. 19 whereby motor 350 rotates in the reverse direction to place cam follower 358 and shaft 352 in the "home" position of the twist member 362. Shaft 466 is also biased to hold lead screw follower 458 out of engagement with the lead screw 356 until another operating cycle commences.

Those skilled in the art will appreciate that two embodiments of an inventive wire tying apparatus have been described in conjunction with the drawing figures hereof, and which have many advantageous features. Both apparatus embodiments described herein may be constructed using conventional engineering materials for pneumatic power operated tools and equipment. An apparatus in accordance with the embodiment described and shown in FIGS. 1 through 9C, for example, may utilize a reversible rotary vane type pressure air motor operating at a working air pressure of about 80–150 psig. A typical time required to complete an operating cycle for the apparatus 30 is about 0.6 seconds and an apparatus weighing approximately twelve pounds may be constructed in accordance with the teachings of the invention. Such apparatus will also operate on wire sizes ranging from about 22 gauge to about 12 gauge without adjusting the apparatus and with an average tie length of about 8.50 inches. Wire may be supplied from a suitably mounted coil from as far away from the apparatus as about fifty feet to about sixty feet. The wire may also be coated with suitable corrosion resistant polymer coatings.

Although preferred embodiments of the invention have been described in detail herein those skilled in the art will recognize that various substitutions and modifications may be made to the apparatus without departing from the scope and spirit of the appended claims.

What is claimed is:

1. Apparatus for tying a length of wire into a loop by twisting opposed ends of the length of wire around each other, said apparatus comprising:

a rotatable wire twist member including opposed hook portions engageable with opposite ends of said length of wire for twisting said opposite ends around each other to form at least one helical wrap;

motor means operable to be drivably connected to said twist member;

a wire guide member disposed adjacent to said twist member for guiding said length of wire into a position to be engaged by said twist member;

a wire feed mechanism operable to feed a length of wire to said wire guide member for engagement by said twist member; and a wire holder and drag member disposed adjacent to said twist member wherein said twist member is disposed between said wire holder and said guide member, and said twist member is rotatable relative to said wire holder and said guide member, respectively, said wire holder comprising a plate supported on said apparatus and including opposed slots formed therein for receiving opposite ends of said length of wire, respectively, and engageable with said opposite ends of said length of wire for holding and tensioning said opposite ends when said opposite ends are twisted together by said twist member.

2. The apparatus set forth in claim 1 including:

a wire guide actuator operably connected to said wire guide member for moving said wire guide member between an open position for receiving a workpiece around which said wire tie is to be placed and a closed position for receiving said length of wire to form a tie around said workpiece.

3. The apparatus set forth in claim 1 including:

a workpiece abutment supported on said apparatus and operable to engage a workpiece for clamping said workpiece between said guide member and said abutment when said guide member is in a closed position for receiving a length of wire.

4. The apparatus set forth in claim 3 wherein:

said abutment comprises a generally circular ring member, and said apparatus includes a support member for said abutment and biasing means for yieldably biasing said abutment into engagement with said workpiece.

5. The apparatus set forth in claim 1 wherein:

said guide member includes a substantially arcuate shaped groove portion formed therein for guiding said length of wire to a position to be engaged by said twist member at opposite ends of said length of wire, said groove having wire entry and exit portions opening in a lateral direction with respect to the plane of said arcuate shaped portion of said groove.

6. The apparatus set forth in claim 5 wherein:

said exit portion of said groove includes a linear portion of said groove and a re-entrant edge for holding said wire in said guide member during at least an initial portion of an operation to twist said wire to form a closure around a workpiece.

7. The apparatus set forth in claim 1 wherein:

said feed mechanism comprises a pair of spaced apart rotatable feedwheels for engaging said wire therebetween and drive means for drivably rotating said feedwheels in timed relationship to each other for feeding wire to said guide member.

8. The apparatus set forth in claim 7 wherein:

said twist member is supported on a rotary shaft operable to be drivenly connected to said motor means, said apparatus includes feed mechanism drive means interconnecting said motor means and said feedwheels, said feed mechanism drive means including a clutch for disengaging a drive connection between said motor means and said feedwheels when said twist member is being rotated to form a wire tie.

9. The apparatus set forth in claim 8 including:

a clutch interconnecting said twist member and said motor means for disengaging said twist member from said motor means during rotation of said feedwheels to feed wire to said guide member.

10. The apparatus set forth in claim 7 wherein:

one of said feedwheels is mounted on a first feedwheel shaft supported on said apparatus on bearing means for allowing lateral excursion of said shaft and said one feedwheel relative to the other of said feedwheels, and said feed mechanism includes means for yieldably biasing said one feedwheel toward said other feedwheel to forcibly engage wire there between.

11. The apparatus set forth in claim 10 including:

one way clutch means operably connected to said first feedwheel shaft to provide for rotation of said one feedwheel in one direction but not the other.

12. The apparatus set forth in claim 11 including:

a moveable key engaged with said one way clutch means and operable to disengage from said clutch means to allow rotation of said first feedwheel shaft in said other direction.

13. The apparatus set forth in claim 7 including:

a right angle gear drive between said motor means and said feedwheels for rotatably driving said feedwheels by motor means.

14. The apparatus set forth in claim 1 wherein:

said feed mechanism includes a linear wire feed actuator, a guide tube for guiding wire to be fed to said guide member, a first wire clamp operably connected to said wire feed actuator and a second wire clamp operably connected to said wire feed actuator at a point spaced from said first wire clamp, said wire feed actuator being operable to cause said first wire clamp to clamp said wire in said guide tube and advance said wire toward said guide member in response to movement of said wire feed actuator while releasing clamping engagement of said wire with said second wire clamp, and said wire feed actuator being operable to release clamping engagement of said wire with said first wire clamp while causing said second wire clamp to clamp said wire when said wire feed actuator is moved in an opposite direction.

15. The apparatus set forth in claim 1 including:

a wire cutter mounted on a frame of said apparatus and operable to cut a length of wire upon feeding said wire to said guide member.

16. The apparatus set forth in claim 15 wherein:

said wire cutter includes a cutter guide member for supporting said wire and responsive to rotation of said twist member to move to effect cutoff of a predetermined length of wire supported in said cutter guide member.

17. The apparatus set forth in claim 1 including:

control means for operating said twist member, said wire guide member and said wire feed mechanism in timed relationship to each other, said control means including a first control valve for valving pressure fluid to a wire guide actuator for actuating said guide member to move to a closed position and means responsive to actuation of said guide member for effecting operation of said wire feed mechanism to feed wire to said guide member.

18. The apparatus set forth in claim 17 wherein:

said means responsive to actuation of said guide member includes a second control valve operably connected to said motor means for supplying pressure fluid thereto, a member responsive to movement of said guide member to said closed position to actuate said second control valve to rotate said motor means to effect operation of said feed mechanism to feed wire to said guide member, and in response to operation of said motor means to effect operation of said second control valve to cause said motor means to reverse its direction of rotation upon feeding a predetermined length of wire to said guide member.

19. The apparatus set forth in claim 18 wherein:

said control means includes means responsive to rotation of said motor means in a direction to effect twisting opposite ends of said length of wire to cause said first control valve to move to a position to effect movement of said guide member to an open position and to effect movement of said second control valve to shut off the flow of pressure fluid to said motor means.

20. The apparatus set forth in claim 17 wherein:

said feed mechanism includes a linear wire feed actuator and said means responsive to operation of said guide actuator includes a second control valve for valving pressure fluid to said wire feed actuator to feed a predetermined length of wire to said guide member.

21. The apparatus set forth in claim 20 wherein:

said wire feed actuator includes means operable for actuating a third control valve for valving pressure fluid to said motor means to rotate said twist member.

22. Apparatus for tying a length of wire to a workpiece by twisting opposite ends of said length of wire together to form a loop closure at said workpiece, said apparatus comprising:

a frame;

a first shaft mounted for rotation on said frame;

a rotatable wire twist member operable to be drivenly connected to said first shaft and engageable with opposite ends of said length of wire for twisting said opposite ends together to form said closure;

a wire feed mechanism supported on said frame and engageable with a length of wire to feed said length of wire into a position to be engaged by said twist member;

a second shaft supported on said frame coaxial with said first shaft for rotation, said second shaft being operable be connected to said feed mechanism for effecting operation of said feed mechanism to feed said length of wire;

motor means supported on said frame for effecting operation of said feed mechanism and rotation of said twist member, respectively;

a first clutch operable to drivingly connect said motor means with said first shaft for rotation of said twist member, said first clutch being disengageable to prevent rotation of said twist member during feeding of said length of wire into said position to be engaged by said twist member; and a second clutch operable to interconnect said motor means and said second shaft with said feed mechanism for operation of said feed mechanism to feed said length of wire, said clutches being connected to actuator means for causing said second clutch to be engaged when said first clutch is disengaged and vice versa.

23. The apparatus set forth in claim 1 including:

control means for causing said motor means to rotate in a first direction during engagement of said second clutch and in an opposite direction during engagement of said first clutch.

24. The apparatus set forth in claim 22 including:

a guide member mounted on said frame for movement between a first position for receiving and releasing a workpiece and a second position for receiving said length of wire from said feed mechanism and a guide actuator mounted on said frame for moving said guide member between said first and second positions.

25. The apparatus set forth in claim 24 wherein:

said guide member includes a substantially arcuate groove formed therein for receiving said length of wire and for guiding said length of wire into a position to be engaged by said twist member.

26. The apparatus set forth in claim 25 wherein:

said groove includes a reentrant edge adjacent a wire exit end of said groove for holding said length of wire in said groove during an initial period of engagement of said length of wire by said twist member.

27. The apparatus set forth in claim 25 wherein:

said groove includes laterally projecting slot portions adjacent a wire receiving end of said groove and a wire discharge end of said groove and a slot portion interconnecting said laterally extending slot portions to provide for releasing said length of wire from said guide member.

28. The apparatus set forth in claim 24 wherein:

said guide member includes a substantially linear portion of said groove for causing said length of wire to exit said guide member in a substantially linear path.

29. Apparatus for tying a length of wire into a loop by twisting opposite ends of the length of wire around each other, said apparatus comprising:

a rotatable wire twist member including opposed hook portions engageable with opposite ends of said length of wire for twisting said opposite ends around each other to form at least one helical wrap;

a wire holder and drag member disposed adjacent to said twist member and engageable with the opposite ends of said length of wire for holding and tensioning said opposite ends when said opposite ends are twisted together by said twist member;

motor means operable to be driveably connected to said twist member;

a wire guide member disposed adjacent to said twist member for guiding said length of wire into a position to be engaged by said twist member;

a wire guide actuator operably connected to said wire guide member for moving said wire guide member between an open position for receiving a workpiece around which said wire tie is to be placed and a closed position for receiving said length of wire to form a tie around said workpiece, said guide actuator including means connected to said wire holder and drag member for moving said wire holder and drag member into a position adjacent said twist member when said wire guide member is in a closed position, said guide actuator being operable to move said wire holder and drag member away from said twist member when said guide member is moved to an open position; and a wire feed mechanism operable to feed a length of wire to said wire guide member for engagement by said twist member.

30. The apparatus set forth in claim 1 wherein:

said guide actuator comprises a pressure fluid operated cylinder and piston actuator mounted on a frame for said apparatus and connected to an arm for moving said guide member between said open and closed positions.

31. The apparatus set forth in claim 30 including:

a link pivotally mounted on said frame and connected to said guide member in supportive relationship thereto by pivot means to provide for movement of said guide member between open and closed positions.

32. Apparatus for tying a length of wire into a loop by twisting opposed ends of the length of wire around each other, said apparatus comprising:

a rotatable wire twist member engageable with opposite ends of said length of wire;

motor means operable to be drivably connected to said twist member;

a wire guide member movable between open and closed positions and disposed adjacent to said twist member for guiding said length of wire into a position to be engaged by said twist member;

a wire feed mechanism operable to feed a length of wire to said wire guide member for engagement by said twist member;

a workpiece abutment comprising a generally circular ring member supported on said apparatus and operable to engage a workpiece for clamping said workpiece between said guide member and said abutment when said guide member is in a closed position for receiving a length of wire; and a support member for said abutment and a biasing spring for yieldably biasing said abutment into engagement with said workpiece when said guide member is in an open position, said biasing spring being operable to reduce a biasing force on said abutment when said guide member is moved to a closed position.

33. Apparatus for tying a length of wire into a loop by twisting opposed ends of the length of wire around each other, said apparatus comprising:

a rotatable wire twist member engageable with opposite ends of said length of wire;

motor means operable to be drivably connected to said twist member;

a wire guide member movable between open and closed positions and disposed adjacent to said twist member for guiding said length of wire into a position to be engaged by said twist member;

a wire feed mechanism operable to feed a length of wire to said guide member for engagement by said twist member;

a workpiece abutment supported on said apparatus and operable to engage a workpiece for clamping said workpiece between said guide member and said abutment when said guide member is in a closed position for receiving a length of wire, said abutment being connected to a guide actuator member for moving said guide member between open and closed positions; and a pressure fluid operated guide actuator connected to said guide actuator member for moving said guide member between said open and closed positions.

34. The apparatus set forth in claim 1 wherein:

said guide actuator comprises a piston and cylinder and said guide actuator member is operably connected to a piston rod for said guide actuator for movement between open and closed positions of said guide member.

35. Apparatus for tying a length of wire into a loop by twisting opposed ends of the length of wire around each other, said apparatus comprising:

a rotatable wire twist member engageable with opposite ends of said length of wire;

motor means operable to be drivably connected to said twist member;

a wire guide member disposed adjacent to said twist member for guiding said length of wire into a position to be engaged by said twist member;

a wire feed mechanism operable to feed a length of wire to said wire guide member for engagement by said twist member;

a wire cutter mounted on a frame of said apparatus and operable to cut a length of wire upon feeding said wire to said guide member, said wire cutter including a cutter guide member for supporting said wire and responsive to rotation of said twist member to move to effect cutoff of a predetermined length of wire supported in said cutter guide member; and means interconnecting said cutter guide member with a clutch interposed between said twist member and said motor means and responsive to engagement of said clutch to drive said twist member to hold said wire cutter in an inoperative position.

36. Apparatus for tying a length of wire into a loop by twisting opposed ends of the length of wire around each other, said apparatus comprising:

a frame;

a rotatable wire twist member supported on said frame and engageable with opposite ends of said length of wire;

motor means operable to be driveably connected to said twist member through a first clutch;

a wire guide member disposed adjacent to said twist member for guiding said length of wire into a position to be engaged by said twist member;

a wire feed mechanism operable to be drivably connected to said motor means through a second clutch to feed a length of wire to said wire guide member for engagement by said twist member; and control means for operating said twist member, said wire guide member and said wire feed mechanism in timed relationship to each other including a first control valve for valving pressure fluid to a wire guide actuator for actuating said guide member to move to a closed position, means responsive to actuation of said guide member for effecting operation of said wire feed mechanism to feed wire to said guide member including a second control valve operably connected to said motor means for supplying pressure fluid thereto, a member responsive to movement of said guide member to said closed position to actuate said second control valve to rotate said motor means to effect operation of said feed mechanism to feed wire to said guide member, and in response to operation of said motor means to effect operation of said second control valve to cause said motor means to reverse its direction of rotation upon feeding a predetermined length of wire to said guide member, means responsive to rotation of said motor means in a direction to effect twisting opposite ends of said length of wire to cause said first control valve to move to a position to effect movement of said guide member to an open position and to effect movement of said second control valve to shut off the flow of pressure fluid to said motor means, a lead screw supported on said frame and drivenly connected to said motor means and a timing nut engageable with said lead screw and responsive to rotation of said motor means to feed a predetermined length of wire to effect operation of said second control valve to reverse the direction of rotation of said motor means, actuate said second clutch to cease operation of said feed mechanism and actuate said first clutch to drivingly engage said motor means with said twist member.

37. The apparatus set forth in claim 1 including:

a link engageable with said nut for effecting movement of said first control valve and said second control valves to positions to move said wire guide member to an open position and stop rotation of said twist member when said ends of said length of wire have been twisted together in a predetermined number of wraps.

38. Apparatus for tying a length of wire into a loop by twisting opposed ends of the length of wire around each other, said apparatus comprising:

a rotatable wire twist member engageable with opposite ends of said length of wire;

motor means operable to be drivably connected to said twist member;

a wire guide member connected to a wire guide actuator and disposed adjacent to said twist member for guiding said length of wire into a position to be engaged by said twist member;

a wire feed mechanism including a linear wire feed actuator operable to feed a length of wire to said wire guide member for engagement by said twist member;

control means for operating said twist member, said wire guide member and said wire feed mechanism in timed relationship to each other, said control means including a first control valve for valving pressure fluid to said wire guide actuator for actuating said guide member to move to a closed position, means responsive to actuation of said guide member including a second control valve for valving pressure fluid to said wire feed actuator to feed a predetermined length of wire to said guide member, said wire feed actuator including means operable for actuating a third control valve for valving pressure fluid to said motor means to rotate said twist member; and a lead screw drivably connected to said motor means and a lead screw follower engageable with said lead screw and responsive to rotation of said lead screw through a predetermined number of revolutions to engage means for effecting disconnection of said lead screw follower from said lead screw.

39. The apparatus set forth in claim 1 wherein:

said lead screw follower is operably connected to a link responsive to disengagement of said lead screw follower from said lead screw to effect operation of said first control valve to cause said guide actuator to move said guide member to an open position, move said feed actuator to a position to feed a successive length of wire and cause said motor means to effect rotation of said twist member to a home position preparatory to commencement of a successive operating cycle of said apparatus.

40. The apparatus set forth in claim 39 including:

a control shaft mounted on said apparatus and operable to disengage said lead screw follower from said lead screw when said motor means is rotating said twist member to said home position and means interconnecting said guide actuator and said control shaft for causing said control shaft to rotate to a position to allow said lead screw follower to engage said lead screw when said guide member is moved to a closed position for receiving a length of wire.

41. Apparatus for tying a length of wire around at least one workpiece by twisting opposed ends of said length of wire around each other and forming a loop closure, said apparatus comprising:

a rotatable wire twist member engageable with opposite ends of said length of wire;

a motor operable to be drivably connected to said twist member for rotating said twist member;

a wire guide member operable to be disposed adjacent to said twist member for guiding said length of wire into a position wherein said opposite ends of said length of wire are operable to be engaged by said twist member;

a wire guide actuator operable to move said guide member between an open position for receiving said workpiece and a closed position for guiding said length of wire;

feed mechanism operable to feed said length of wire to said guide member; and a wire holder member on said apparatus disposed adjacent said twist member and including opposed slot means formed therein for receiving said opposite ends of said length of wire for engagement of said opposite ends by said holder member during engagement of said length of wire by said twist member to impart a drag force on said opposite ends of said length of wire during rotation of said twist member.

42. The apparatus set forth in claim 1 wherein:

said holder member comprises a plate mounted in a predetermined position with respect to said twist member, said twist member being mounted on said apparatus for rotation between said guide member and said plate.

43. The apparatus set forth in claim 42 wherein:

said holder member is operably connected to said wire guide actuator and is movable to a position adjacent said twist member when said guide member is moved to a closed position and to a position away from said twist member when said guide member is moved to an open position.

44. The apparatus set forth in claim 43 wherein:

said wire guide actuator comprises a pressure fluid operated piston and cylinder actuator including a cylinder member and piston rod extending therefrom, said guide member is operably connected to said piston rod and said holder member is connected to said cylinder member whereby in response to movement of said actuator to effect movement of said guide member to a closed position said holder member moves toward said twist member.

45. Apparatus for tying a length of wire around at least one workpiece by twisting opposed ends of said length of wire around each other and forming loop closure, said apparatus comprising:

a rotatable wire twist member engageable with opposite ends of said length of wire;

a motor operable to be drivably connected to said twist member for rotating said twist member;

a wire guide member operable to be disposed adjacent to said twist member for guiding said length of wire into a position wherein said opposite ends of said length of wire are operable to be engaged by said twist member;

a wire guide actuator operable to move said guide member between an open position for receiving said workpiece and a closed position for guiding said length of wire;

feed mechanism operable to feed said length of wire to said guide member;

a wire holder member on said apparatus engageable with said opposite ends of said length of wire during engagement of said length of wire by said twist member to impart a drag force on said opposite ends of said length of wire; and an abutment disposed in a position on said apparatus for engaging a workpiece between guide member and said abutment when said guide member is in said closed position, said abutment is connected to said wire guide actuator for movement toward said twist member when said guide member is moved to said closed position and movable away from said twist member when said guide member is moved to said open position.

46. The apparatus set forth in claim 1 wherein:

said abutment includes biasing means interconnecting said abutment with said wire guide actuator for urging said abutment away from said twist member with a first biasing force when said guide member is in an open position, said biasing means being operable to reduce said biasing force on said abutment when said wire guide actuator moves said guide member to said closed position.

47. The apparatus set forth in claim 46 wherein:

said apparatus includes an actuator member interconnecting said wire guide actuator and said guide member for moving said guide member between open and closed positions in response to operation of said wire guide actuator, said abutment includes opposed support rods engageable with said actuator member and said biasing means comprises spring means interconnecting said actuator member and at least one of said support rods for exerting said biasing force on said abutment.

48. Apparatus for tying a length of wire to a workpiece by twisting opposite ends of said length of wire together to form a loop closure at said workpiece, said apparatus comprising:

a frame;

a first shaft mounted for rotation on said frame;

a rotatable wire twist member drivenly connected to said first shaft and engageable with opposite ends of said length of wire for twisting said opposite ends together to form said closure;

a wire feed mechanism supported on said frame and engageable with a length of wire to feed said length of wire into a position to be engaged by said twist member;

a second shaft supported on said frame for rotation, said second shaft being operable be connected to said feed mechanism for effecting operation of said feed mechanism to feed said length of wire;

motor means supported on said frame and operable to be drivingly connected to said second shaft and said first shaft for effecting operation of said feed mechanism and rotation of said twist member, respectively; and a wire cutoff mechanism mounted on said frame and engageable with a cam mounted on said first shaft, said wire cutoff mechanism being responsive to rotation of said first shaft to effect cutting wire to a predetermined length.

49. The apparatus set forth in claim 48 including:

an actuator engageable with said wire cutoff mechanism for holding said wire cutoff mechanism in a position out of engagement with said cam.

* * * * *